US010462565B2

(12) United States Patent
Brunet et al.

(10) Patent No.: US 10,462,565 B2
(45) Date of Patent: Oct. 29, 2019

(54) DISPLACEMENT LIMITER FOR LOUDSPEAKER MECHANICAL PROTECTION

(71) Applicant: Samsung Electronics Co., Ltd., Suwon-si, Gyeonggi-do (KR)

(72) Inventors: Pascal M. Brunet, Pasadena, CA (US); Glenn S. Kubota, Northridge, CA (US)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/835,245

(22) Filed: Dec. 7, 2017

(65) Prior Publication Data

US 2018/0192192 A1 Jul. 5, 2018

Related U.S. Application Data

(60) Provisional application No. 62/442,259, filed on Jan. 4, 2017, provisional application No. 62/484,175, filed on Apr. 11, 2017.

(51) Int. Cl.
*H04R 3/00* (2006.01)
*H04R 3/04* (2006.01)
(Continued)

(52) U.S. Cl.
CPC ..... *H04R 3/007* (2013.01); *H04R 3/04* (2013.01); *H04R 9/06* (2013.01); *H04R 29/001* (2013.01)

(58) Field of Classification Search
CPC . H04R 3/007; H04R 3/04; H04R 9/06; H04R 29/001; H04R 29/003
See application file for complete search history.

(56) References Cited

U.S. PATENT DOCUMENTS 5,870,484 A * 2/1999 Greenberger ..... H04R 5/02 381/17
6,059,926 A 5/2000 Hiroshima
(Continued)

FOREIGN PATENT DOCUMENTS

EP 1799013 B1 2/2010
EP 2642769 A1 9/2013
(Continued)

OTHER PUBLICATIONS

International Search Report and Written Opinion dated Mar. 31, 2017 for International Application PCT/KR2016/015435 from Korean Intellectual Property Office, pp. 1-12, Republic of Korea.
(Continued)

*Primary Examiner* — Sonia L Gay
(74) *Attorney, Agent, or Firm* — Sherman IP LLP; Kenneth L. Sherman; Hemavathy Perumal

(57) ABSTRACT

One embodiment provides a device comprising a speaker driver including a diaphragm. The device further comprises a controller configured to receive a source signal for reproduction via the speaker driver, determine an estimated displacement of the diaphragm resulting from the reproduction of the source signal, and generate a control voltage based on the estimated displacement and threshold information relating to safe displacement of the diaphragm. An actual displacement of the diaphragm during the reproduction of the source signal is controlled based on the control voltage.

20 Claims, 17 Drawing Sheets

(51) Int. Cl.

| | |
|---|---|
| ***H04R 9/06*** | (2006.01) |
| ***H04R 29/00*** | (2006.01) |

(56) References Cited

U.S. PATENT DOCUMENTS

| | | | | |
|---|---|---|---|---|
| 6,275,592 | B1 | 8/2001 | Vartiainen | |
| 7,024,014 | B1 | 4/2006 | Noll | |
| 7,348,908 | B2 | 3/2008 | Slavin | |
| 7,359,519 | B2 | 4/2008 | Lee et al. | |
| 7,372,966 | B2 | 5/2008 | Bright | |
| 7,467,071 | B2 | 12/2008 | Manrique et al. | |
| 7,688,984 | B2 | 3/2010 | De Callafon | |
| 8,073,149 | B2 | 12/2011 | Kuze | |
| 8,086,956 | B2 | 12/2011 | Su et al. | |
| 8,130,994 | B2 | 3/2012 | Button et al. | |
| 8,146,989 | B2 | 4/2012 | Godiska et al. | |
| 8,204,210 | B2 | 6/2012 | van de Laar et al. | |
| 8,391,498 | B2 | 3/2013 | Potard | |
| 8,538,040 | B2 | 9/2013 | Kirn | |
| 8,855,322 | B2 | 10/2014 | Ryu et al. | |
| 9,042,561 | B2 | 5/2015 | Gautama et al. | |
| 9,130,527 | B2 | 9/2015 | Potard | |
| 9,154,101 | B2 | 10/2015 | Dhuyvetter | |
| 9,161,126 | B2 | 10/2015 | Su et al. | |
| 9,374,634 | B2 | 6/2016 | Macours et al. | |
| 9,432,771 | B2 | 8/2016 | Oyetunji et al. | |
| 9,553,554 | B2 | 1/2017 | Kimura et al. | |
| 9,578,416 | B2 | 2/2017 | Gautama et al. | |
| 9,635,454 | B2 | 4/2017 | Larrien | |
| 9,661,428 | B2 | 5/2017 | Holladay et al. | |
| 9,837,971 | B2 | 12/2017 | Luo et al. | |
| 9,883,305 | B2 | 1/2018 | Risberg et al. | |
| 9,900,690 | B2 | 2/2018 | Risberg et al. | |
| 9,967,652 | B2 | 5/2018 | Baird et al. | |
| 10,219,090 | B2 | 2/2019 | Adams et al. | |
| 2002/0141098 | A1 | 10/2002 | Schlager | |
| 2004/0028242 | A1 | 2/2004 | Kitamura | |
| 2005/0122166 | A1 | 6/2005 | Premakanthan et al. | |
| 2006/0274904 | A1 | 12/2006 | Lashkari | |
| 2007/0098190 | A1 | 5/2007 | Song et al. | |
| 2009/0180636 | A1 | 7/2009 | Su et al. | |
| 2011/0182435 | A1 | 7/2011 | Gautama | |
| 2012/0203526 | A1 | 8/2012 | Bai et al. | |
| 2012/0289809 | A1* | 11/2012 | Kaib | A61B 5/04085 600/388 |
| 2013/0094657 | A1 | 4/2013 | Brammer et al. | |
| 2014/0051483 | A1 | 2/2014 | Schoerkmaier | |
| 2014/0254827 | A1* | 9/2014 | Bailey | H04R 3/04 381/98 |
| 2014/0286500 | A1 | 9/2014 | Iwamoto et al. | |
| 2015/0010171 | A1 | 1/2015 | Pernici et al. | |
| 2015/0124982 | A1* | 5/2015 | Berthelsen | H04R 29/001 381/59 |
| 2015/0281844 | A1 | 10/2015 | Stabile | |
| 2015/0319529 | A1 | 11/2015 | Klippel et al. | |
| 2016/0134982 | A1 | 5/2016 | Iyer | |
| 2016/0360331 | A1 | 12/2016 | Yeh | |
| 2017/0055067 | A1 | 2/2017 | Moro et al. | |
| 2017/0188150 | A1 | 6/2017 | Brunet et al. | |
| 2017/0272045 | A1 | 9/2017 | Chadha | |
| 2017/0318388 | A1 | 11/2017 | Risberg et al. | |
| 2017/0325024 | A1* | 11/2017 | Hu | H04R 29/001 |
| 2018/0014120 | A1 | 1/2018 | Lawrence et al. | |
| 2018/0034430 | A1* | 2/2018 | Ahmed | H03F 3/45475 |
| 2019/0222939 | A1 | 7/2019 | Brunet at al. | |
| 2019/0281385 | A1 | 9/2019 | Brunet et al. | |

FOREIGN PATENT DOCUMENTS

| | | | |
|---|---|---|---|
| EP | 3079375 | A1 | 10/2016 |
| JP | 3433342 | B2 | 8/2003 |
| JP | 2004312141 | A | 11/2004 |
| JP | 2005129977 | A | 5/2005 |
| JP | 2007060648 | A | 3/2007 |
| JP | 2007081815 | A | 3/2007 |
| JP | 2015082754 | A | 4/2015 |
| JP | 2015084499 | A | 4/2015 |
| JP | 6182869 | B2 | 8/2017 |
| KR | 10-20050023841 | A | 3/2005 |
| KR | 10-20140097874 | A | 8/2014 |
| KR | 101445186 | B1 | 10/2014 |
| WO | 2013182901 | A1 | 12/2013 |
| WO | 2014045123 | A | 3/2014 |
| WO | 2015143127 | A | 9/2015 |
| WO | 2015191691 | A1 | 12/2015 |

OTHER PUBLICATIONS

Thomsen, S. et. al., "Design and Analysis of a Flatness-Based Control Approach for Speed Control of Drive Systems with Elastic Couplings and Uncertain Loads," Proceedings of the 2011—14th European Conference (EPE 2011), Aug. 30-Sep. 1, 2011, pp. 1-10, IEEE Press, United States.

Fliess, M. et al., "Flatness and Defect of Nonlinear Systems: Introductory Theory and Examples", International Journal of Control, Jun. 1995, pp. 1327-1361, vol. 61, Taylor & Francis, United Kingdom.

Papazoglou, N. et al., "Linearisation par Asservissement d'unhaut—parleur electrodynamique: approach par les Systemes Hamiltoniens a Ports", Memoire de Fin D Etude M2R SAR Parcourt ATIAM, pp. 1-52, Aug. 11, 2014.

Extended European Search Report dated Jul. 23, 2018 for European Application No. 16882101.5 from European Patent Office, pp. 1-8, Munich, Germany.

Hu, Y. et al., "Effects of the Cone and Edge on the Acoustic Characteristics of a Cone Loudspeaker", Advances in Acoustics and Vibration, May 21, 2017, pp. 1-12, vol. 2017, Hindawi, Japan.

International Search Report and Written Opinion dated Apr. 20, 2018 for International Application PCT/KR2018/000016 from Korean Intellectual Property Office, pp. 1-5, Republic of Korea.

U.S. Non-Final Office Action for U.S. Appl. No. 15/391,633, dated Mar. 28, 2019.

U.S. Notice of Allowance for U.S. Appl. No. 16/057,711 dated Apr. 2, 2019.

International Search Report and Written Opinion dated Apr. 29, 2019 for International Application PCT/KR2019/000702 from Korean Intellectual Property Office, pp. 1-10, Republic of Korea.

ProSoundWeb, "Harman Unveils JBL 3 Series Mk II Powered Studio Monitors," Jan. 2018, pp. 1-4, EH Publishing, United States, downloaded at: https://www.prosoundweb.com/channels/recording/harman-unveils-jbl-3-series-mkii-powered-studio-monitors/.

International Search Report and Written Opinion dated May 7, 2019 for International Application PCT/KR2019/001090 from Korean Intellectual Property Office, pp. 1-13, Republic of Korea.

U.S. Notice of Allowance for U.S. Appl. No. 15/873,530 dated Jul. 18, 2019.

International Search Report dated Jun. 21, 2019 for International Application PCT/KR2019/002741 from Korean Intellectual Property Office, pp. 1-3, Republic of Korea.

U.S. Notice of Allowability for U.S. Appl. No. 15/873,530 dated Aug. 28, 2019.

U.S. Notice of Allowability for U.S. Appl. No. 15/873,530 dated Sep. 9, 2019.

* cited by examiner

500

520

510

530

700

DISPLACEMENT LIMITER FOR LOUDSPEAKER MECHANICAL PROTECTION

CROSS-REFERENCE TO RELATED APPLICATIONS

The present application claims priority to U.S. Provisional Patent Application No. 62/442,259, filed on Jan. 4, 2017. The present application further claims priority to U.S. Provisional Patent Application No. 62/484,175, filed on Apr. 11, 2017. Both patent applications are hereby incorporated by reference in their entireties.

COPYRIGHT DISCLAIMER

A portion of the disclosure of this patent document may contain material that is subject to copyright protection. The copyright owner has no objection to the facsimile reproduction by anyone of the patent document or the patent disclosure as it appears in the patent and trademark office patent file or records, but otherwise reserves all copyright rights whatsoever.

TECHNICAL FIELD

One or more embodiments relate generally to loudspeakers, and in particular, a displacement limiter for mechanical protection of a loudspeaker.

BACKGROUND

A loudspeaker produces sound when connected to an integrated amplifier, a television (TV) set, a radio, a music player, an electronic sound producing device (e.g., a smartphone), a video player, etc.

SUMMARY

One embodiment provides a device comprising a speaker driver including a diaphragm. The device further comprises a controller configured to receive a source signal for reproduction via the speaker driver, determine an estimated displacement of the diaphragm resulting from the reproduction of the source signal, and generate a control voltage based on the estimated displacement and threshold information relating to safe displacement of the diaphragm. An actual displacement of the diaphragm during the reproduction of the source signal is controlled based on the control voltage.

These and other features, aspects and advantages of the one or more embodiments will become understood with reference to the following description, appended claims and accompanying figures.

DETAILED DESCRIPTION

Figure 1A:
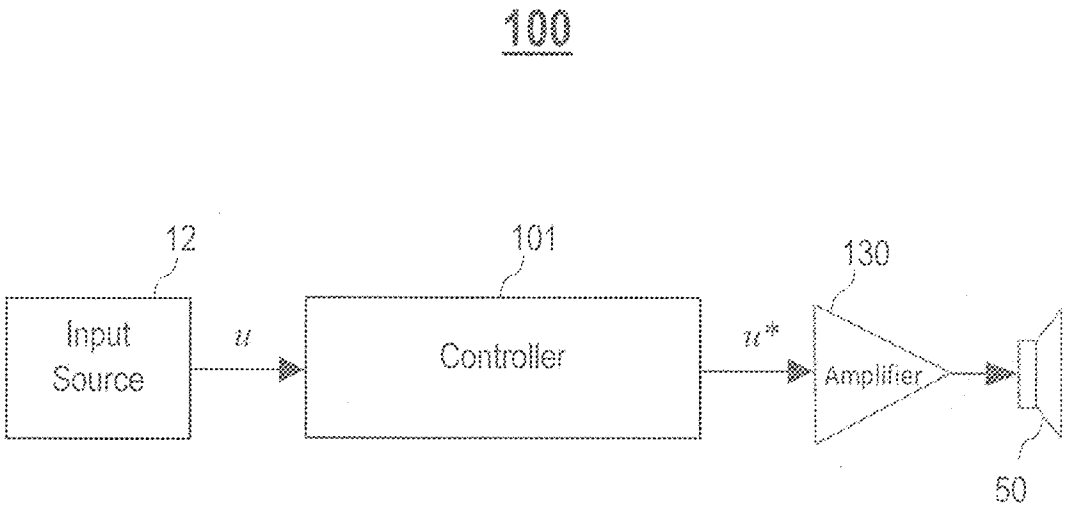
FIG. 1A illustrates an example displacement limiter system, in accordance with an embodiment.

The following description is made for the purpose of illustrating the general principles of one or more embodiments and is not meant to limit the inventive concepts claimed herein. Further, particular features described herein can be used in combination with other described features in each of the various possible combinations and permutations. Unless otherwise specifically defined herein, all terms are to be given their broadest possible interpretation including meanings implied from the specification as well as meanings understood by those skilled in the art and/or as defined in dictionaries, treatises, etc.

For expository purposes, the terms "loudspeaker" and "loudspeaker device" may be used interchangeably in this specification.

For expository purposes, the terms "displacement limiter" and "displacement limiter system" may be used interchangeably in this specification.

For expository purposes, the terms "displacement" and "excursion" may be used interchangeably in this specification.

One embodiment provides a device comprising a speaker driver including a diaphragm. The device further comprises a controller configured to receive a source signal for reproduction via the speaker driver, determine an estimated displacement of the diaphragm resulting from the reproduction of the source signal, and generate a control voltage based on the estimated displacement and threshold information relating to safe displacement of the diaphragm. An actual displacement of the diaphragm during the reproduction of the source signal is controlled based on the control voltage.

A conventional displacement limiter for a loudspeaker operates based on an assumption that a final displacement of one or more moving components of the loudspeaker is approximately proportional to an input voltage provided to the loudspeaker. This leads to imprecision that may require overhead, time constants, frequency band tuning, etc.

Excessive displacement may result in bottoming and suspension stretch of a loudspeaker. Such repeated mechanical overload may eventually destroy the loudspeaker. Furthermore, if an input provided to an amplifier of the loudspeaker requires an amount of output voltage that the amplifier cannot supply, resulting audio output from the loudspeaker may be clipped, causing unpleasant audio distortion.

One or more embodiments provide a displacement limiter for a loudspeaker that provides mechanical protection of the loudspeaker. One or more embodiments further provide a displacement limiter for a loudspeaker that prevents transient distortions due to amplifier clipping of an audio signal (e.g., hard/soft clipping).

In one embodiment, a displacement limiter for a loudspeaker limits/restricts displacement of a diaphragm and a driver voice coil of the loudspeaker based on a physical model of the loudspeaker to reduce/prevent repeated excess displacement. Specifically, in response to an input voltage received at the loudspeaker for driving the loudspeaker, the displacement limiter is configured to: (1) based on the physical model, determine an estimated (i.e., predicted) displacement of one or more moving components of the loudspeaker (e.g., the diaphragm and/or the driver voice coil) at each instant/moment (e.g., each sampling time) since receipt of the input voltage, (2) compare the estimated displacement against predetermined displacement limits that ensure safe operation of the loudspeaker for mechanical protection (i.e., safety limits or safe range of operation), and (3) limit/restrict (i.e., coerce) the estimated displacement to a target displacement that is within the predetermined displacement limits based on the comparison, such that an actual displacement of the one or more moving components of the loudspeaker is within the safe range of operation. Therefore, unlike conventional displacement limiters for loudspeakers that make crude approximations of displacement, one or more embodiments described herein provide a displacement limiter configured to determine an estimated displacement and instantaneously (or within a specified allowable time deviation) correct time samples of an input audio signal that may result in excess displacement.

In one example implementation, the displacement limiter is configured to limit/restrict the estimated displacement by utilizing a time-domain algorithm without time constants (i.e., attack/release) or dynamic filtering. Specifically, the displacement limiter is configured to: (1) determine a control voltage that produces the target displacement based on the physical model, and (2) apply the control voltage determined to an amplifier of the loudspeaker, thereby reducing displacement of the one or more moving components of the loudspeaker and reducing transducer voltage (i.e., amplifier voltage).

In another example implementation, the displacement limiter is configured to limit/restrict the estimated displacement by utilizing a frequency-domain algorithm. Specifically, the displacement limiter is configured to: (1) update a cutoff frequency of a high-pass filter (HPF) of the loudspeaker based on the estimated displacement, and (2) apply the HPF with the updated cutoff frequency to the input voltage, thereby reducing displacement of the one or more moving components of the loudspeaker.

In yet another example implementation, the displacement limiter is configured to limit/restrict the estimated displacement by: (1) updating a cutoff frequency of the HPF based on the predetermined displacement limits that ensure safe operation of the loudspeaker and predetermined voltage capabilities of the amplifier of the loudspeaker, and (2) applying the HPF with the updated cutoff frequency to the input voltage, thereby reducing both displacement of the one or more moving components of the loudspeaker and amplifier voltage.

In yet another embodiment, a displacement limiter for a loudspeaker utilizes a combination of a time-domain algorithm and a frequency-domain algorithm.

Figure 2:
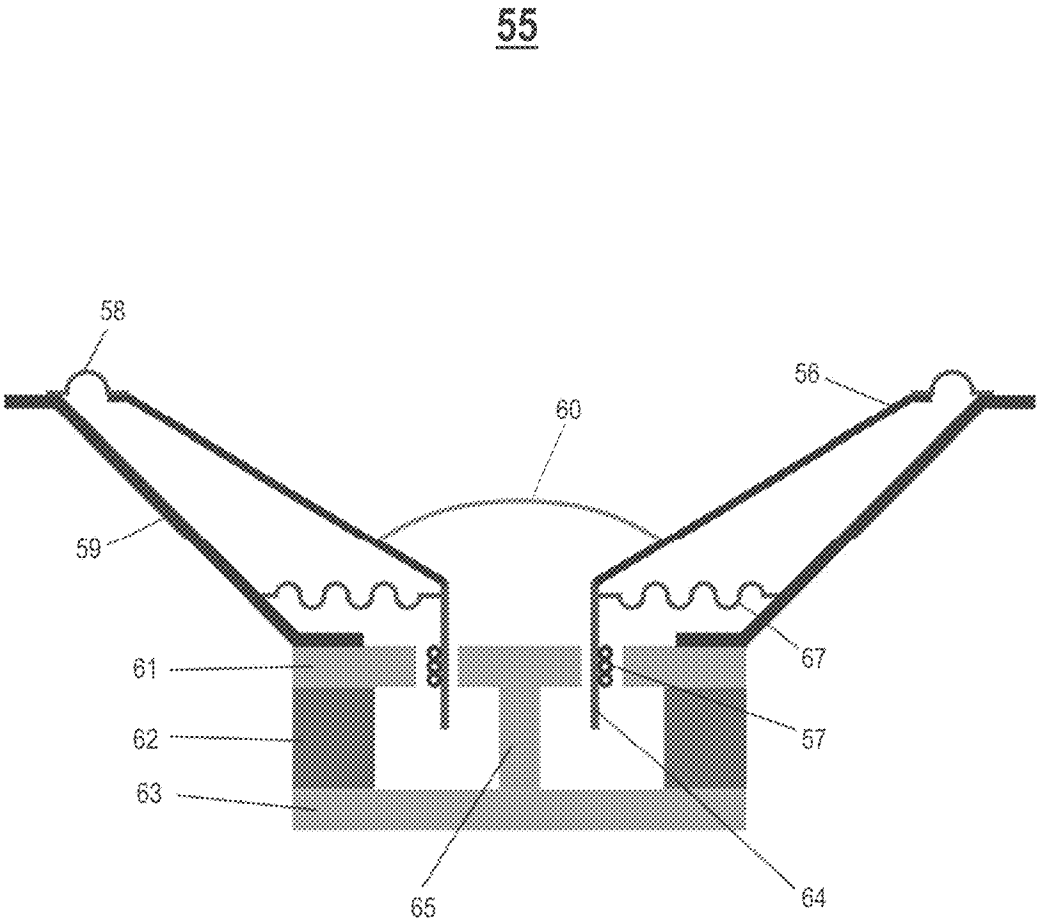
FIG. 2 illustrates a cross section of an example speaker driver, in accordance with an embodiment.

FIG. 1A illustrates an example displacement limiter system 100, in accordance with an embodiment. The displacement limiter system 100 comprises a loudspeaker device 50. In one embodiment, the loudspeaker device 50 is a closed-box loudspeaker including at least one speaker driver 55 (FIG. 2) for reproducing sound, such as a woofer, etc. In one embodiment, at least one speaker driver 55 of the loudspeaker device 50 is a forward-facing speaker driver. In another embodiment, at least one speaker driver 55 of the loudspeaker device 50 is an upward-facing driver. In yet another embodiment, at least one speaker driver 55 of the loudspeaker device 50 is a downward-facing driver. Each speaker driver 55 of the loudspeaker device 50 includes one or more moving components, such as a diaphragm 56 (FIG. 2) and a driver voice coil 57 (FIG. 2).

Let u generally denote an input voltage received at the displacement limiter system 100 for driving the loudspeaker device 50. The displacement limiter system 100 further comprises a controller 101 configured to: (1) receive a source signal (e.g., an input audio signal) with voltage u from an input source 12, (2) determine an estimated displacement of the one or more moving components (i.e., diaphragm 56 and/or driver voice coil 57) of the loudspeaker device 50 that results from reproduction of the source signal, and (3) generate a control voltage u* based on the estimated displacement and threshold information relating to safe displacement of the one or more moving components.

The displacement limiter system 100 further comprises an amplifier 130 connected to the loudspeaker device 50 and the controller 101. The amplifier 130 is configured to amplify the source signal based on the control voltage u*, thereby controlling an actual displacement of the one or more moving components during the reproduction of the source signal based on the control voltage u*.

In one embodiment, the controller 101 is configured to receive a source signal from different types of input sources 12. Examples of different types of input sources 12 include, but are not limited to, a mobile electronic device (e.g., a smartphone, a laptop, a tablet, etc.), a content playback device (e.g., a television, a radio, a computer, a music player such as a CD player, a video player such as a DVD player, a turntable, etc.), or an audio receiver, etc.

In one embodiment, the displacement limiter system 100 may be integrated in, but not limited to, one or more of the following: a computer, a smart device (e.g., smart TV), a subwoofer, wireless and portable speakers, car speakers, etc.

Figure 1B:
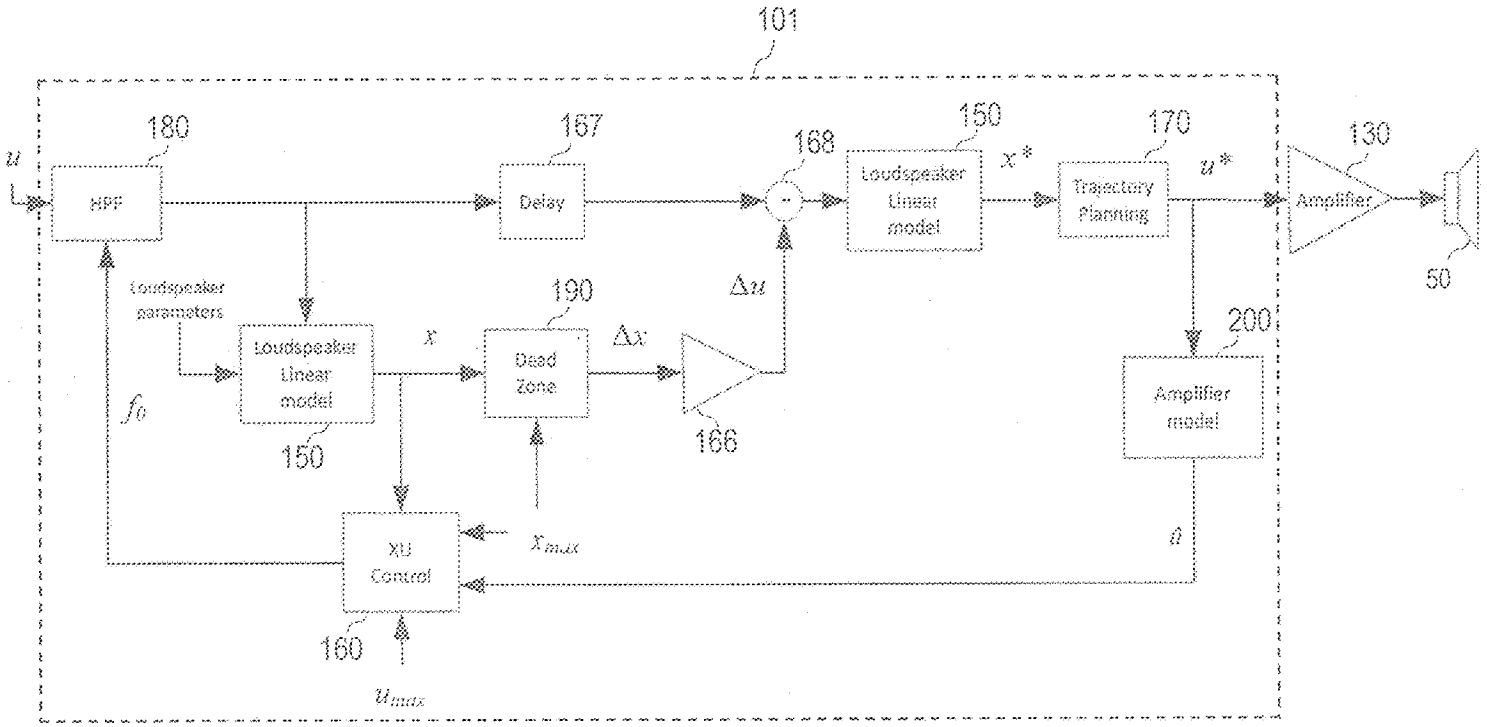
FIG. 1B illustrates an example implementation of a controller of the displacement limiter system, in accordance with an embodiment.

FIG. 1B illustrates an example implementation of the controller 101, in accordance with an embodiment. The controller 101 is configured to modify transducer voltage (i.e., voltage of the amplifier 130) for one or more time samples of a source signal in response to determining that reproduction of the one or more time samples results in a potential excess of displacement of the one or moving components.

In one embodiment, the controller 101 comprises at least one physical model 150 for the loudspeaker device 50. In one example implementation, at least one physical model 150 utilized by the controller 101 is a linear model (e.g., a linear state-space model). In another example implementation, at least one physical model 150 utilized by the controller 101 is a nonlinear model. The nonlinear model may be combined with a time-domain low latency displacement limiter to catch sudden displacement increases. As described in detail later herein, a physical model 150 can be based on one or more loudspeaker parameters for the loudspeaker device 50. In one embodiment, a physical model 150 may be implemented using a $3^{rd}$-order infinite impulse response (IIR) filter.

Let x generally denote an estimated displacement of one or more moving components (e.g., diaphragm 56 and/or driver voice coil 57) of the loudspeaker device 50 at a particular moment/instant (i.e., time sample). Let $x_{max}$ generally denote a predetermined maximum displacement limit for the one or more moving components that ensures safe operation of the loudspeaker device 50 for mechanical protection (e.g., ensures safe operation based on threshold information relating to safe displacement of the one or more moving components). Let x* generally denote a target displacement of the one or more moving components that is within a range ensuring safe operation of the loudspeaker device 50 ("safe range of operation"), wherein the safe range of operation is defined by the predetermined maximum displacement limit $x_{max}$.

In one embodiment, the controller 101 is configured to: (1) receive an input voltage u, (2) based on a physical model 150, determine an estimated displacement x of the one or more moving components at each instant/moment (i.e., each time sample) since receipt of the input voltage u, (3) compare the estimated displacement x against the predetermined maximum displacement limit $x_{max}$, and (4) based on the comparison, limit/restrict (i.e., coerce) the estimated displacement x to a target displacement x* that is within the safe range of operation as defined by the predetermined maximum displacement limit $x_{max}$.

In one embodiment, the controller 101 comprises a trajectory planning unit 170 configured to determine, based on a physical model 150, a control voltage u* that produces the target displacement x*. The amplifier 130 amplifies the source signal in accordance with the control voltage u*, thereby limiting the estimated displacement x of the one or more moving components to the target displacement x* that is within the safe range of operation.

In one example implementation, the controller 101 applies a time-domain algorithm to limit/restrict the estimated displacement x to the target displacement x*. Specifically, the controller 101 applies a soft-saturation function to the estimated displacement x to obtain the target displacement x* that is limited to the safe range of operation. Let psi(x, a, b) generally denote a saturation function, wherein a and b are scalar constants. In one embodiment, a saturation function psi(x, a, b) implemented by the controller 101 is represented in accordance with equation (1) provided below:

$$psi(x,a,b)=x/\mathrm{norm}([1,x/b],a) \quad (1).$$

In another example implementation, instead of applying a soft-saturation function, the controller 101 limits/restricts the estimated displacement x to the target displacement x* by performing voltage correction on the input voltage u based on a displacement excess Δx representing a marginal (i.e., excess) amount of the estimated displacement x that exceeds the predetermined maximum displacement limit $x_{max}$ (i.e., Δx represents a potential excess of displacement of the one or more moving components). Specifically, in one embodiment, the controller 101 further includes one or more of the following optional components: (1) a dead zone unit 190 configured to determine the displacement excess Δx by applying a gating function (i.e., a dead zone function) that factors into account the estimated displacement x and the predetermined maximum displacement limit $x_{max}$, (2) an amplifier 166 configured to amplify the displacement excess Δx to obtain a voltage excess Δu representing a marginal (i.e., excess) amount of the input voltage u that results in the displacement excess Δx, (3) a delay unit 167 (i.e., a delay block) configured to delay the input voltage u by a predetermined amount of time to ensure time synchronization with voltage correction, and (4) a subtraction unit 168 configured to perform voltage correction on the input voltage u by subtracting the voltage excess Δu from the delayed input voltage u.

In one embodiment, the controller 101 is further configured to dynamically attenuate sound reproduced by the loudspeaker device 50 at one or more predetermined frequency ranges to maintain an actual displacement of the one or moving components within the safe range of operation. In one embodiment, the controller 101 further comprises an optional HPF 180 that is applied to the input voltage u to provide sliding equalization. The controller 101 further comprises an optional control unit 160 configured to determine a cutoff frequency of the HPF 180 that limits/restricts the estimated displacement x. In one example implementation, the control unit 160 is configured to: (1) determine the cutoff frequency based on the estimated displacement x, and (2) trigger the HPF 180 to update to the cutoff frequency, wherein the updated HPF 180 is applied to the input voltage u to reduce displacement. In another example implementation, the control unit 160 is configured to: (1) determine the cutoff frequency based on the predetermined maximum displacement limit $x_{max}$ and a predetermined maximum voltage limit $u_{max}$ of the amplifier 130 (e.g., ensures safe operation based on threshold information relating to the amplifier 130), and (2) trigger the HPF 180 to update to the new cutoff frequency. The updated HPF 180 is applied to the input voltage u to reduce both displacement of one or more moving components and transducer voltage (i.e., voltage of the amplifier 130).

Let X(t) generally denote a vector representing a state ("state vector representation") of the loudspeaker device 50 at a sampling time t, wherein the state vector representation X(t) is defined in accordance with equation (2) provided below:

$$X(t)=[x,v,i]^T \quad (2),$$

wherein v is a velocity of the one or more moving components, and i is a current through the speaker driver 55. For expository purposes, the terms X(t) and X are used interchangeably in this specification. As described in detail later herein, in one embodiment, the controller 101 determines an estimated displacement x recursively for each sampling time t based on the input voltage u, the state vector representation X of the loudspeaker device 50, and at least one physical model 150 (e.g., a physical model 151 shown in FIG. 4).

In one embodiment, the controller 101 is further configured to reduce audio distortion in audio output reproduced by the amplifier 130 (i.e., provide amplifier clipping protection). In one embodiment, the controller 101 further comprises an optional amplifier model 200 for determining an estimated (i.e., predicted) output voltage û of the amplifier 130 (i.e., transducer voltage). In one example implementation, the amplifier model 200 determines an estimated output voltage û by multiplying the input voltage u by an amplifier gain. The control unit 160 is further configured to: (1) compare the estimated output voltage û against the predetermined maximum voltage limit $u_{max}$, (2) determine a cutoff frequency of the HPF 180 based on a combination of the estimated displacement x and the estimated output voltage û, and (3) trigger an update of the HPF 180 with the cutoff frequency determined to reduce both displacement of one or more moving components of the loudspeaker device 50 and transducer voltage.

In one embodiment, the amplifier model 200 may account for power supply bus sag to improve prediction of amplifier clipping.

FIG. 2 illustrates a cross section of an example speaker driver 55, in accordance with an embodiment. The speaker driver 55 includes a diaphragm 56 (e.g., a cone-shaped diaphragm) and a driver voice coil 57. The speaker driver 55 further comprises one or more of the following components: (1) a surround roll 58 (i.e., suspension roll), (2) a basket 59, (3) a protective cap 60 (e.g., a dome-shaped dust cap), (4) a top plate 61, (5) a magnet 62, (6) a bottom plate 63, (7) a pole piece 65, (8) a former 64, and (9) a spider 67.

Figure 3:
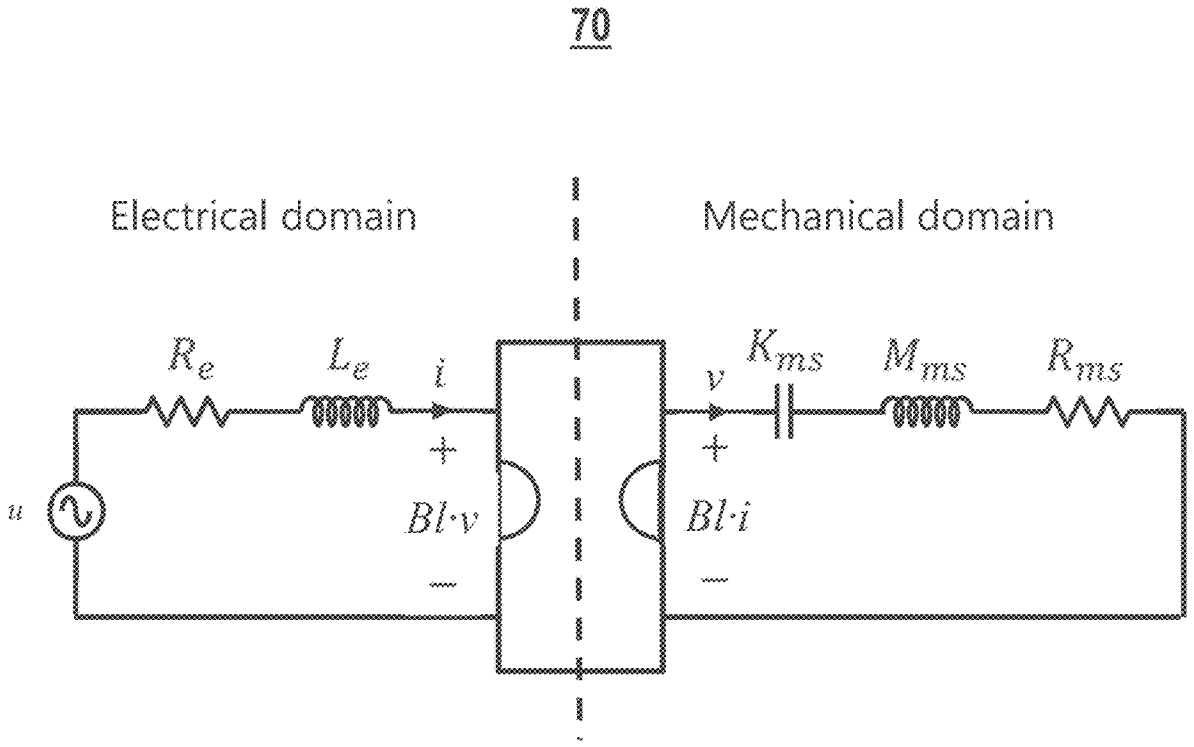
FIG. 3 illustrates an example electroacoustic model for a speaker driver, in accordance with an embodiment.

FIG. 3 illustrates an example electroacoustic model 70 for a speaker driver 55, in accordance with an embodiment. A loudspeaker parameter may be classified into one of the following domains: an electrical domain or a mechanical domain. Examples of different loudspeaker parameters in the electrical domain include, but are not limited to, the following: (1) an input voltage u, (2) an electrical direct current (DC) resistance $R_e$ of a driver voice coil 57 of the speaker driver 55, (3) a current i through the speaker driver 55, (4) an inductance $L_e$ of the driver voice coil 57, and (5) a product term Bl·v representing a product of a force factor Bl of the driver voice coil 57 and a velocity v of the driver voice coil 57.

Examples of different loudspeaker parameters in the mechanical domain include, but are not limited to, the following: (1) the velocity v of the driver voice coil 57, (2) a mechanical mass $M_{ms}$ of a diaphragm 56 of the speaker driver 55 (i.e., moving mass), the driver voice coil 57, and air load, (3) a mechanical resistance $R_{ms}$ of total losses of the speaker driver 55 (i.e., mechanical losses), (4) a stiffness factor $K_{ms}$ of a surround roll 58 of the speaker driver 55, and (6) a product term Bl·i representing a product of the force factor Bl of the driver voice coil 57 and the current i through the speaker driver 55.

In one embodiment, if the trajectory planning unit 170 utilizes a nonlinear model, the loudspeaker parameters Bl, $K_{ms}$, and $L_e$ may be functions based on an estimated displacement x.

Figure 4:
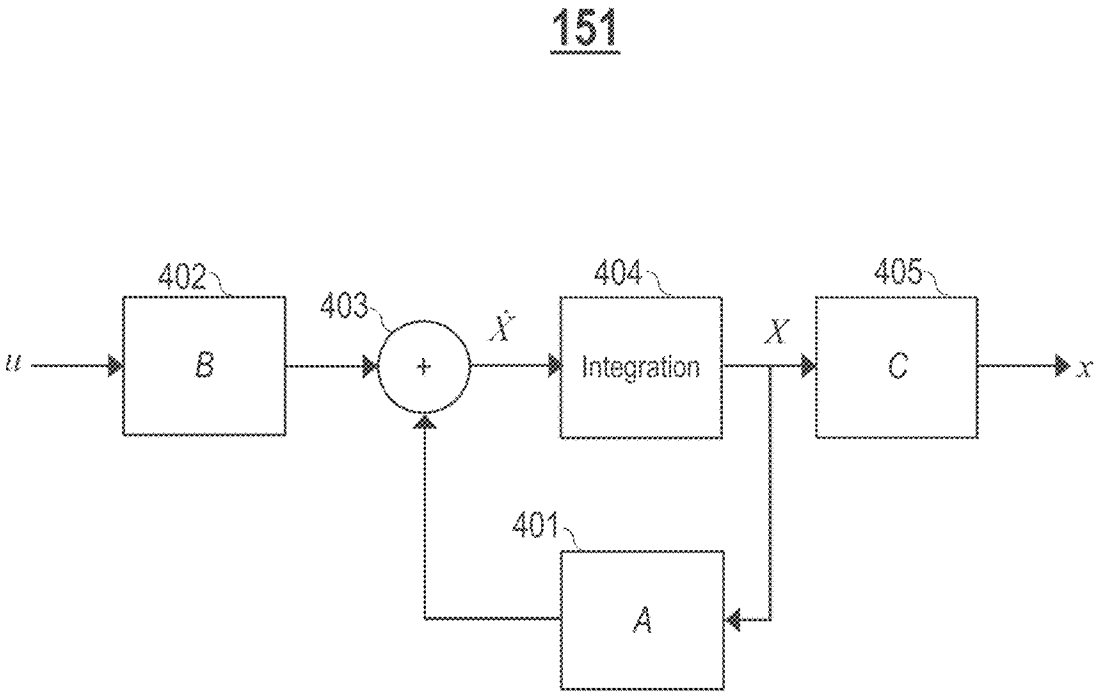
FIG. 4 illustrates an example physical model for the loudspeaker device, in accordance with an embodiment.

FIG. 4 illustrates an example physical model 151 for the loudspeaker device 50, in accordance with an embodiment. The physical model 151 can be an example linear state-space model. In one embodiment, an estimated displacement x of one or more components of a loudspeaker device 50 (e.g., a diaphragm 56 and/or a driver voice coil 57) is determined recursively for each sampling time t based on an input voltage u received for driving the loudspeaker device 50 and a state vector representation X(t) of the loudspeaker device 50 using the physical model 151.

Let A, B, and C generally denote constant parameter matrices. In one embodiment, the constant parameter matrices A, B, and C are represented in accordance with equations (3)-(5) provided below:

$$A = \begin{bmatrix} 0 & 1 & 0 \\ -K_{ms}/M_{ms} & -R_{ms}/M_{ms} & -Bl/M_{ms} \\ 0 & -Bl/L_e & -R_e/L_e \end{bmatrix}, \tag{3}$$

$$B = \begin{bmatrix} 0 \\ 0 \\ 1/L_e \end{bmatrix}, \text{ and} \tag{4}$$

$$C = [1 \quad 0 \quad 0]. \tag{5}$$

Let $\dot{X}$ generally denote a time derivative (i.e., rate of change) of the state vector representation X of the loudspeaker device 50 ("state vector rate of change"), wherein the state vector rate of change $\dot{X}$ is defined in accordance with a differential equation (6) provided below:

$$\dot{X}=AX+Bu \tag{6}.$$

In one embodiment, an estimated displacement x is computed in accordance with equation (7) provided below:

$$x=CX \tag{7}.$$

In one embodiment, recursively determining an estimated displacement x for each sampling time t involves performing a recursive set of computations that are based on equations (3)-(7) provided above. In one example implementation, the controller 101 comprises one or more of the following components: (1) a first multiplication unit 401 configured to determine a product term AX by multiplying the constant parameter matrix A with the state vector representation X, (2) a second multiplication unit 402 configured to determine a product term Bu by multiplying the constant parameter matrix B with the input voltage u, (3) an addition unit 403 configured to determine the state vector rate of change $\dot{X}$ by adding the product terms AX and Bu in accordance with equation (6) provided above, (4) an integration unit 404 configured to determine the state vector representation X by integrating the state vector rate of change $\dot{X}$ in the Laplace s-domain, and (5) a third multiplication unit 405 configured to determine an estimated displacement x by multiplying the constant parameter matrix C with the state vector representation X in accordance with equation (7) provided above.

Figure 5A:
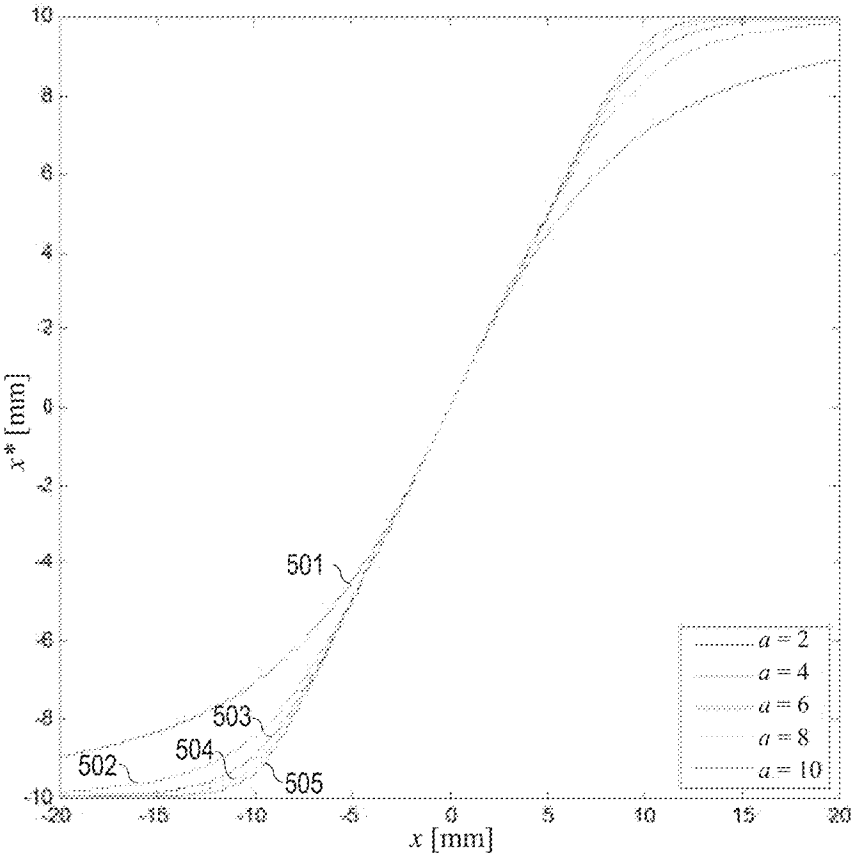
FIG. 5A is an example graph illustrating different saturation functions that may be applied by the controller implementing a time-domain algorithm, in accordance with an embodiment.

FIG. 5A is an example graph 500 illustrating different saturation functions that may be applied by the controller implementing a time-domain algorithm, in accordance with an embodiment. A horizontal axis of the graph 500 represents estimated displacement x of one or more moving components of the loudspeaker device 50 (e.g., diaphragm 56 and/or driver voice coil 57) in millimeters (mm). A vertical axis of the graph 500 represents resulting target displacement x* of the one or more moving components in mm. As stated above, in one embodiment, the controller 101 implements a time-domain algorithm by applying a soft-saturation function to an estimated displacement x to obtain a resulting target displacement x* that is within a safe range of operation for a loudspeaker device 50.

The graph 500 comprises each of the following: (1) a first curve 501 representing a first saturation function $psi_1(x, a, b)$, wherein a=2, (2) a second curve 502 representing a second saturation function $psi_2(x, a, b)$, wherein a=4, (3) a third curve 503 representing a third saturation function $psi_3(x, a, b)$, wherein a=6, (4) a fourth curve 504 representing a fourth saturation function $psi_4(x, a, b)$, wherein a=8, and (5) a fifth curve 505 representing a fifth saturation function $psi_5(x, a, b)$, wherein a=10. As shown in FIG. 5A, application of each saturation function results in a target displacement x* with a maximum magnitude that is less than 10 mm.

Figure 5B:
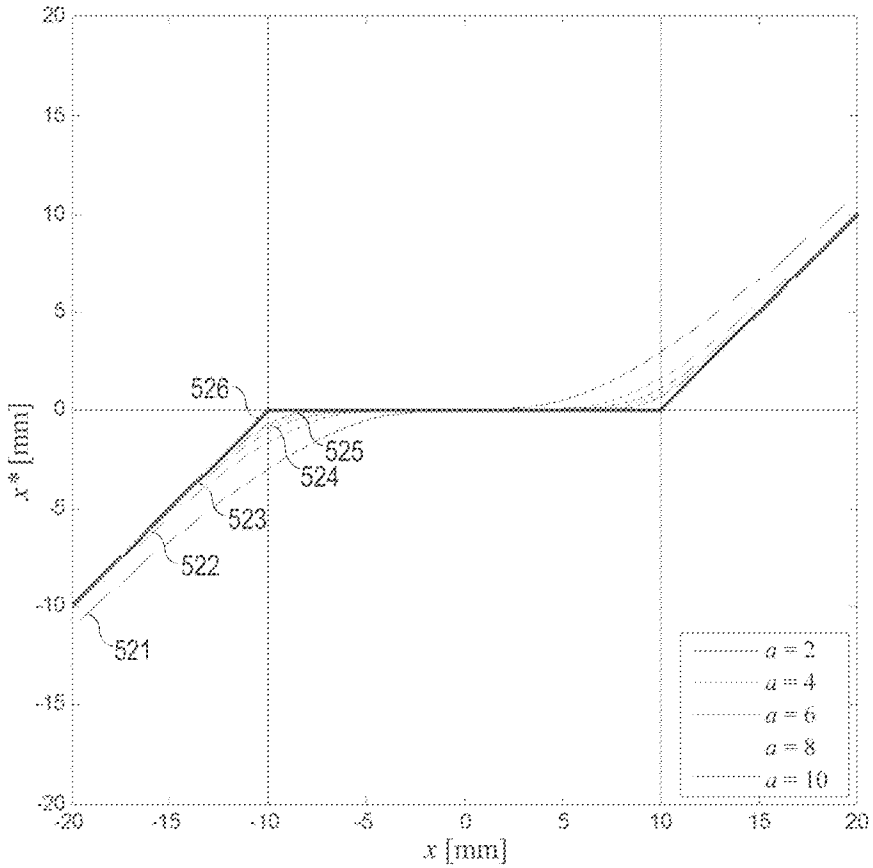
FIG. 5B is an example graph comparing a target displacement resulting from application of a dead zone function versus other target displacements resulting from application of saturation functions, in accordance with an embodiment.

FIG. 5B is an example graph 520 comparing a target displacement resulting from application of a dead zone function versus other target displacements resulting from application of saturation functions, in accordance with an embodiment. A horizontal axis of the graph 520 represents estimated displacement x of one or more moving components of the loudspeaker device 50 (e.g., diaphragm 56 and/or driver voice coil 57) in mm. A vertical axis of the graph 520 represents target displacement x* of the one or more moving components in mm. As stated above, in one embodiment, instead of applying a soft-saturation function, the controller 101 is configured to apply a gating function (e.g., via the dead zone unit 190) to obtain a marginal (i.e., excess) amount Δx of an estimated displacement x that exceeds the predetermined maximum displacement limit $x_{max}$, and limit/restrict the estimated displacement x to a target displacement x* based on the marginal amount Δx.

As shown in FIG. 5B, the graph 520 comprises each of the following: (1) a first curve 521 representing the first saturation function $psi_1(x, a, b)$ (i.e., a=2), (2) a second curve 522 representing the second saturation function $psi_2(x, a, b)$ (i.e., a=4), (3) a third curve 523 representing the third saturation function $psi_3(x, a, b)$ (i.e., a=6), (4) a fourth curve 524 representing the fourth saturation function $psi_4(x, a, b)$ (i.e., a=8), (5) a fifth curve 525 representing the fifth saturation function $psi_5(x, a, b)$ (i.e., a=10), and (6) a sixth curve 526 representing a gating function. As shown in FIG. 5B, with the exception of the first saturation function, application of the gating function to each remaining saturation function results in a target displacement x* with a maximum magnitude of about 10 mm.

Figure 6:
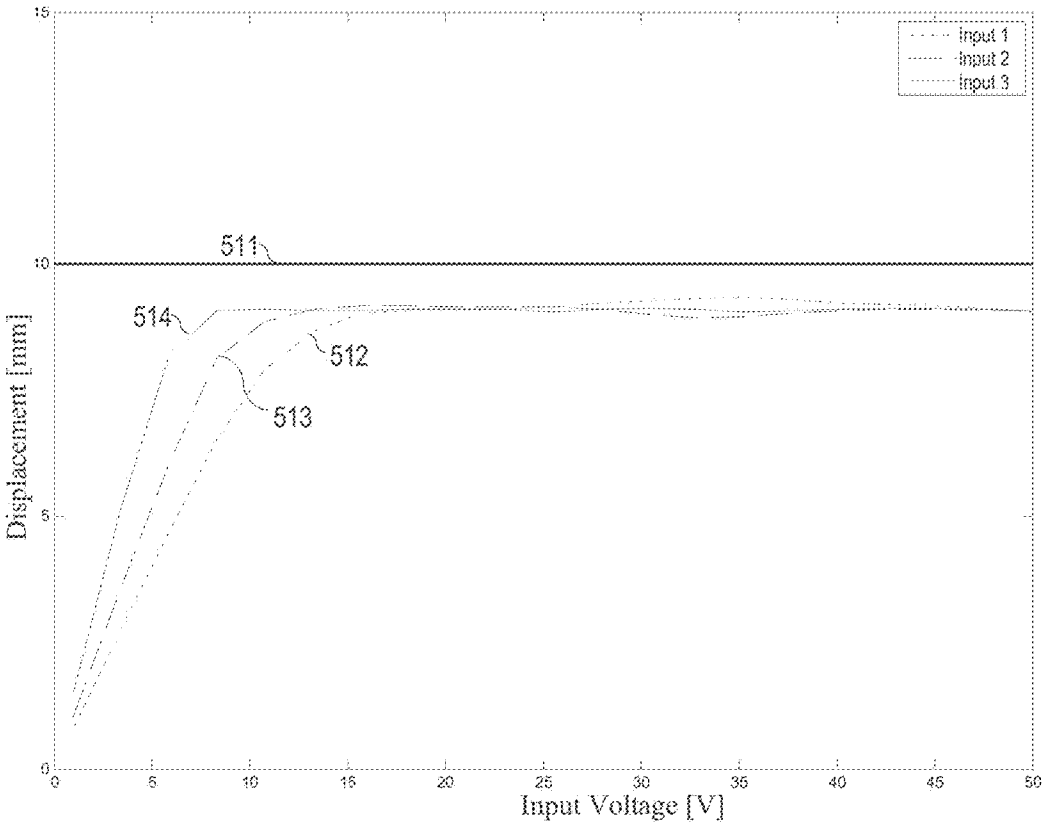
FIG. 6 is an example graph illustrating different resulting limited displacements of one or more moving components of a loudspeaker device of the displacement limiter system in response to different source signals, in accordance with an embodiment.

FIG. 6 is an example graph 510 illustrating different resulting limited displacements of one or more moving components of the loudspeaker device 50 in response to different source signals, in accordance with an embodiment. A vertical axis of the graph 510 represents displacement of the one or more moving components (e.g., diaphragm 56 and/or driver voice coil 57) in mm. A horizontal axis of the graph 510 represents input voltage received by the displacement limiter system 100 in volts (V). The graph 510 comprises each of the following: (1) a horizontal line 511 representing a predetermined maximum displacement limit $x_{max}$, wherein $x_{max}$=10 mm, (2) a first curve 512 representing displacement and voltage for a first source signal Input 1 received by the displacement limiter system 100, (3) a second curve 513 representing displacement and voltage for a second source signal Input 2 received by the displacement limiter system 100, and (4) a third curve 514 representing displacement and voltage for a third source signal Input 3 received by the displacement limiter system 100. As shown in FIG. 6, the displacement limiter system 100 limits/restricts displacement of the one or more moving components for each source signal received, such that each source signal results in a displacement amount with a maximum magnitude that is less than the predetermined maximum displacement limit $x_{max}$ (i.e., less than 10 mm).

Figure 7A:
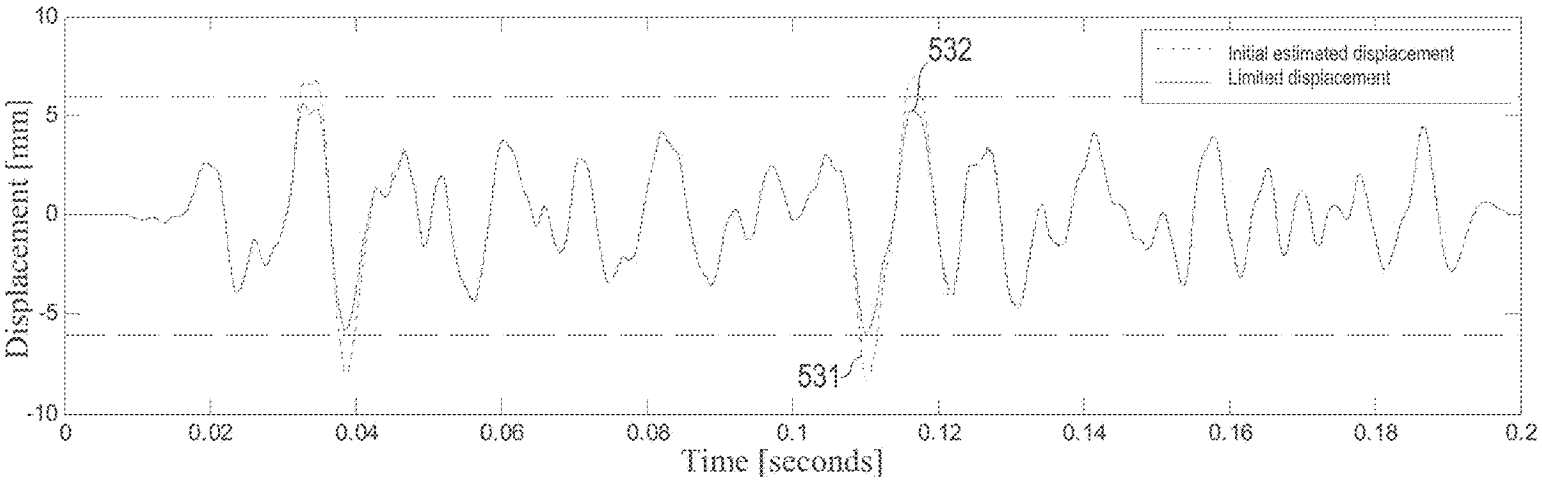
FIG. 7A is an example graph illustrating displacement reduction, in accordance with an embodiment.
Figure 7B:
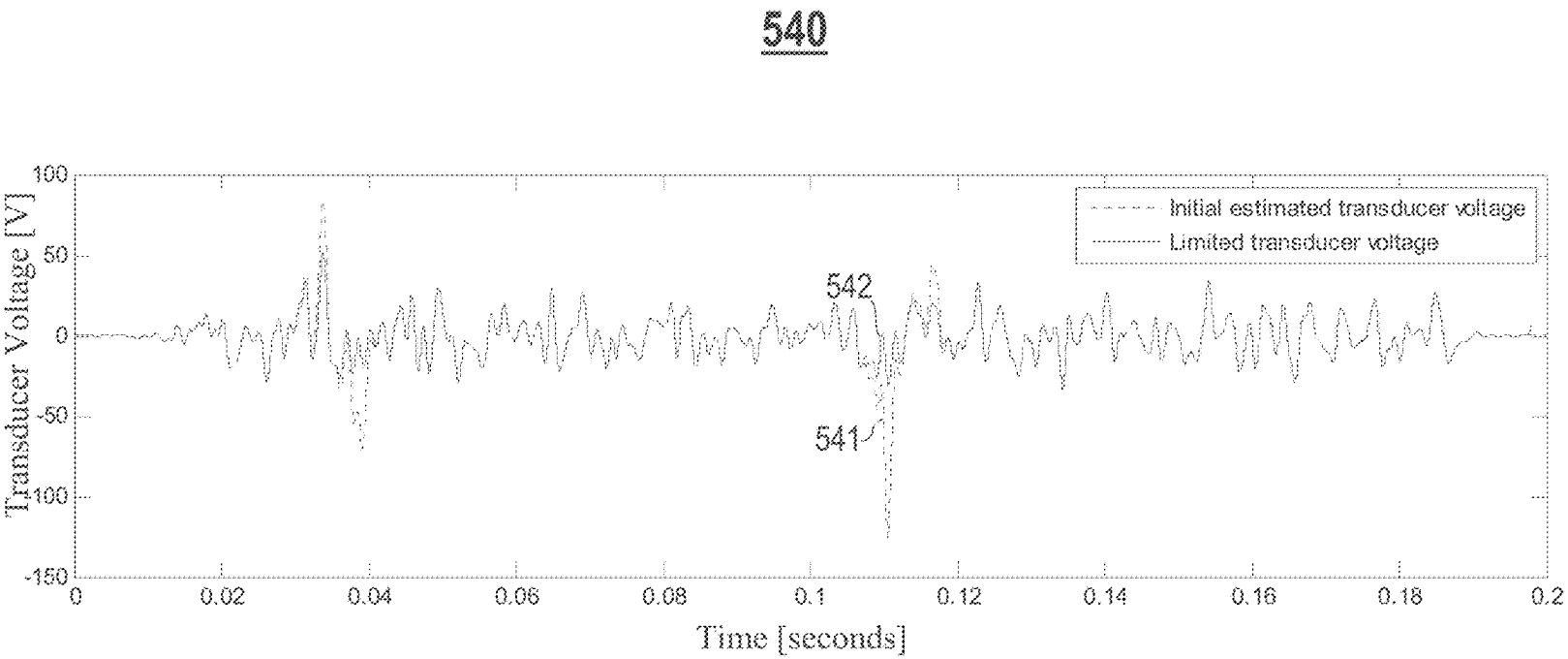
FIG. 7B is an example graph illustrating transducer voltage reduction, in accordance with an embodiment.

FIGS. 7A-7B are example graphs illustrating results of utilizing the displacement limiter system 100 when a time-domain algorithm is implemented, in accordance with some embodiments. Specifically, FIG. 7A is an example graph 530 illustrating displacement reduction, in accordance with an embodiment. A vertical axis of the graph 530 represents displacement of one or more moving components of the loudspeaker device 50 (e.g., diaphragm 56 and/or a driver voice coil 57 of a loudspeaker device 50) in mm. A horizontal axis of the graph 530 represents time in seconds. The graph 530 comprises each of the following: (1) a first curve 531 representing an initial estimated displacement of the one or more moving components (e.g., an estimated displacement x), and (2) a second curve 532 representing a resulting limited displacement of the one or more moving components (e.g., a target displacement x*). As shown in FIG. 7A, the first curve 531 has higher peaks and lower dips compared to the second curve 532, thereby illustrating displacement reduction. For example, the first curve 531 has a displacement amount with a maximum magnitude of approximately 8.25 mm, whereas the second curve 532 has a displacement amount with a maximum magnitude of approximately 6.00 mm instead.

FIG. 7B is an example graph 540 illustrating transducer voltage reduction, in accordance with an embodiment. A vertical axis of the graph 540 represents transducer voltage for the loudspeaker device 50 in V. A horizontal axis of the graph 540 represents time in seconds. The graph 540 comprises each of the following: (1) a first curve 541 representing an initial estimated transducer voltage (e.g., estimated output voltage û), and (2) a second curve 542 representing a resulting limited transducer voltage (e.g., control voltage u*). As shown in FIG. 7B, the first curve 541 has higher peaks and lower dips compared to the second curve 542, thereby illustrating transducer voltage reduction. For example, the first curve 541 has a transducer voltage amount with a maximum magnitude of approximately 125.66 V, whereas the second curve 542 has a transducer voltage amount with a maximum magnitude of approximately 51.66 V instead.

As stated above, in one embodiment, the displacement limiter system 100 is configured to limit/restrict an estimated displacement x by utilizing a frequency-domain algorithm. Specifically, the displacement limiter system 100 updates a cutoff frequency of the HPF 180, and applies the HPF 180 with the updated cutoff frequency to an input voltage u to limit/restrict an estimated displacement x.

In one embodiment, the displacement limiter system 100 updates a cutoff frequency of the HPF 180 based on an estimated displacement x. In one example implementation, the displacement limiter system 100 updates a cutoff frequency of the HPF 180 in accordance with equation (8) provided below:

$$f(x)=f_{min}+(f_{max}-f_{min})|x/x_{max}| \quad (8),$$

wherein f(x) is an instantaneous/current cutoff frequency that the HPF 180 is updated with, $f_{min}$ and $f_{max}$ are predetermined frequency limits that define a frequency range within which a cutoff frequency of the HPF 180 is limited to for reducing excursion, and |x| is an absolute value of an estimated displacement x. In one embodiment, a cutoff frequency of the HPF 180 is updated at each sampling time. In one embodiment, either |x| or f(x) are low-pass filtered (e.g., exponential averaging) to smooth fluctuations. Different time constants for attack/release may be implemented.

In another embodiment, the displacement limiter system 100 updates a cutoff frequency of the HPF 180 based on predetermined displacement limits that ensure safe operation of the loudspeaker device 50 (e.g., a predetermined maximum displacement limit $x_{max}$) and predetermined voltage capabilities of an amplifier 130 of the loudspeaker device 50 (e.g., a predetermined maximum voltage limit $u_{max}$). Specifically, in one example implementation, the displacement limiter system 100 is configured to: (1) determine, based on at least one physical model of the loudspeaker device 50 and an input voltage u, an estimated displacement x of one or more moving components of the loudspeaker device 50 (e.g., diaphragm 56 and/or driver voice coil 57) at each sampling time t, (2) compare the estimated displacement x against a predetermined maximum displacement limit $x_{max}$, (3) determine, based on at least one model of the amplifier 130 (e.g., amplifier model 200) and the input voltage u, a transducer voltage, (4) compare the transducer voltage against a predetermined maximum voltage limit $u_{max}$, and (5) adjust a cut-off frequency of the HPF 180 based on the comparisons.

TABLE 1 below provides example pseudo-code implemented by the displacement limiter system 100 to update cutoff frequency of a HPF (e.g., HPF 180).

TABLE 1

// increase cutoff frequency of the HPF if there is excess displacement
If $(x_{pk} > x_{max})$, then $f_0 = f_0 + k_x * (x_{pk} - x_{max}) * t$
// increase cutoff frequency of the HPF if there is excess voltage
If $(u_{pk} > u_{max})$, then $f_0 = f_0 + k_u * (u_{pk} - u_{max}) * t$
// decrease cutoff frequency of the HPF if there is no excess excursion and excess voltage
If $(x_{pk} < x_{max})$ & $(u_{pk} < u_{max})$, then $f_0 = f_0 - k_{rd} * t$
// limit/restrict cutoff frequency of the HPF
If $f_0 > f_{max}$, then $f_0 = f_{max}$
// limit/restrict cutoff frequency of the HPF
If $f_0 < f_{min}$, then $f_0 = f_{min}$
Where:
$x_{pk}$ is a maximum estimated displacement (i.e., excursion peak) within an audio frame
$x_{max}$ is a predetermined maximum displacement limit
$f_0$ is a current/instantaneous cutoff frequency of the HPF
$k_x$ is a ramp-up rate that is applied if there is excess displacement
t is a time period for one audio frame
$u_{pk}$ is a maximum estimated voltage (i.e., voltage peak) within an audio frame
$u_{max}$ is a predetermined maximum voltage limit
$k_u$ is a ramp-up rate that is applied if there is excess voltage
$k_{rd}$ is a ramp-down rate that is applied if there is no excess displacement and excess voltage
$f_{max}$ is a predetermined/desired maximum frequency limit of the HPF
$f_{min}$ is a predetermined/desired minimum frequency limit of the HPF In yet another embodiment, the displacement limiter system 100 is configured to limit/restrict an estimated displacement x by utilizing combination of a time-domain algorithm and a frequency-domain algorithm.

As stated above, in one embodiment, the displacement limiter system 100 is further configured to reduce audio distortion in audio output reproduced by the amplifier 130 of the loudspeaker device 50, thereby providing amplifier clipping protection.

In one embodiment, the HPF 180 is a time-varying filter with one or more parameters that change continuously for each sampling time. In one embodiment, the displacement limiter system 100 is configured to recalculate one or more coefficients of the HPF 180 for each new value of a desired corner frequency.

Figure 8:
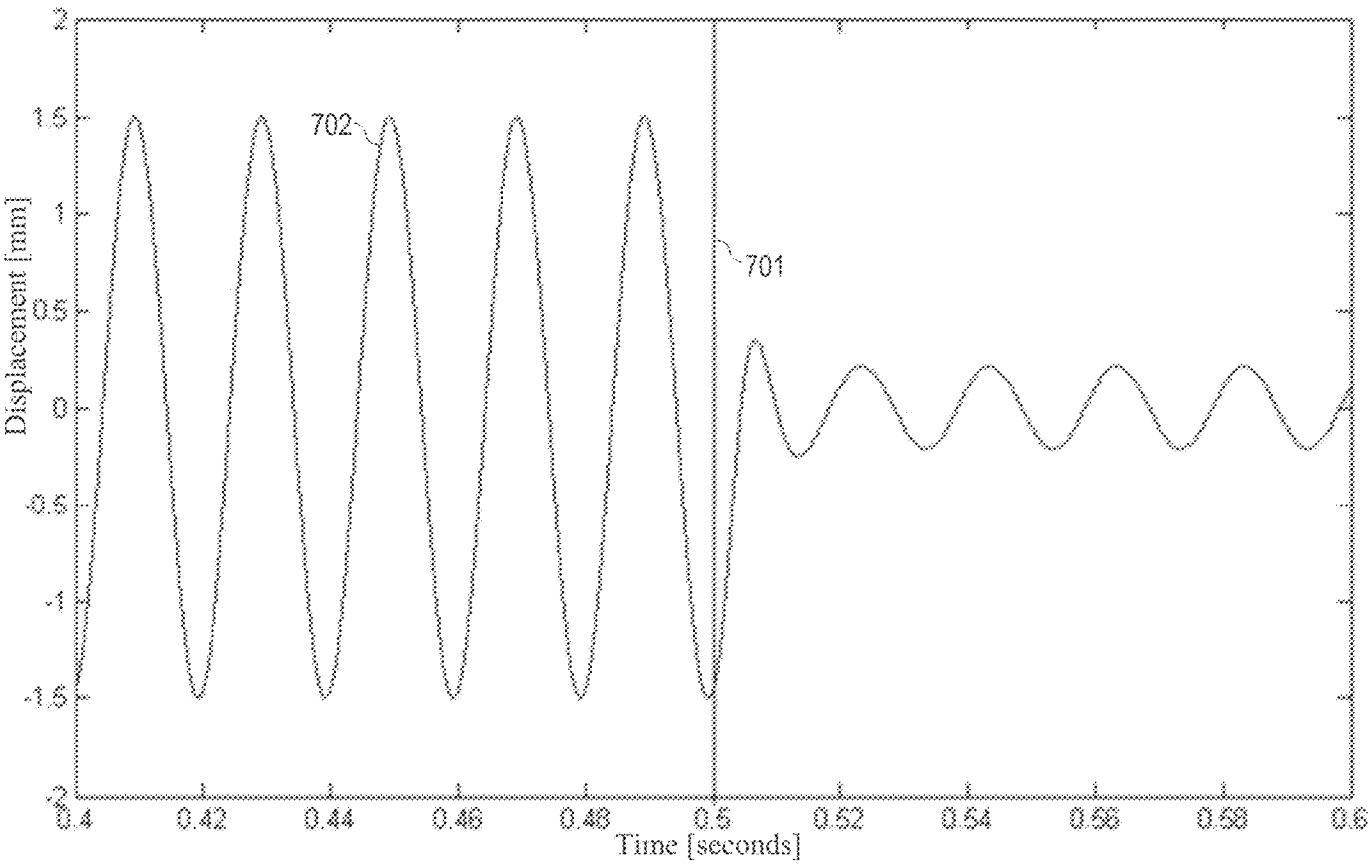
FIG. 8 is an example graph illustrating an example output signal (e.g., audio output) reproduced by the loudspeaker device, in accordance with an embodiment.

FIG. 8 is an example graph 700 illustrating an example output signal (e.g., audio output) reproduced by the loudspeaker device 50, in accordance with an embodiment. A vertical axis of the graph 700 represents displacement of one or more moving components (i.e., diaphragm 56 and/or driver voice coil 57) of the loudspeaker device 50 (e.g., target displacement x*) in mm. A horizontal axis of the graph 700 represents time in seconds. The graph 700 comprises each of the following: (1) a vertical line 701 representing a time point at which there is a transition in a desired corner frequency of the HPF 180 (e.g., an abrupt transition from 40 Hz to 100 Hz), and (2) a curve 702 representing resulting limited displacement of the one or more moving components (e.g., target displacement x*) during reproduction of the output signal. As shown in FIG. 8, there is no discontinuity in the output signal during the transition.

Figure 9A:
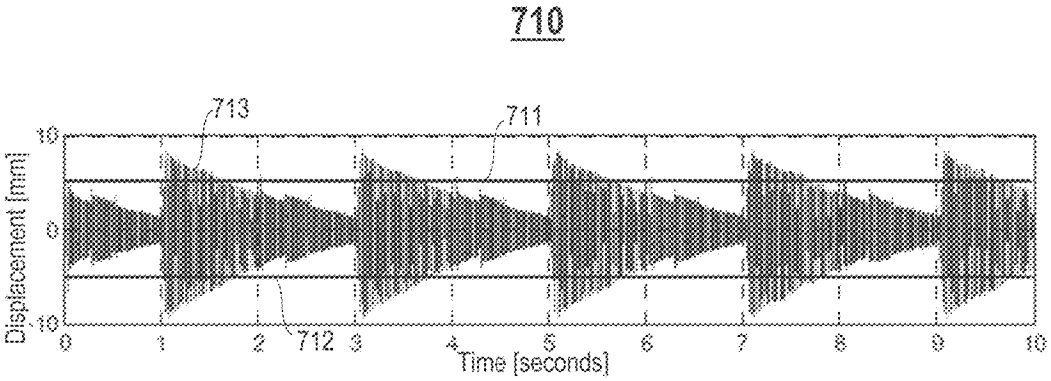
FIG. 9A is an example graph illustrating a displacement response waveform of a conventional loudspeaker with fixed equalization.

FIG. 9A is an example graph 710 illustrating a displacement response waveform of a conventional loudspeaker with fixed equalization. A vertical axis of the graph 710 represents displacement in mm. A horizontal axis of the graph 710 represents time in seconds. The graph 710 comprises each of the following: (1) a pair of horizontal lines 711 and 712 representing predetermined displacement limits for one or more moving components of the loudspeaker that ensure safe operation of the loudspeaker for mechanical protection (e.g., ensure safe operation based on threshold information relating to safe displacement of the one or more moving components), and (2) a response waveform 713 representing resulting actual displacement of the one or more moving components during audio reproduction. As shown in FIG. 9A, with fixed equalization, the resulting actual displacement frequently exceeds the predetermined displacement limits.

Figure 9B:
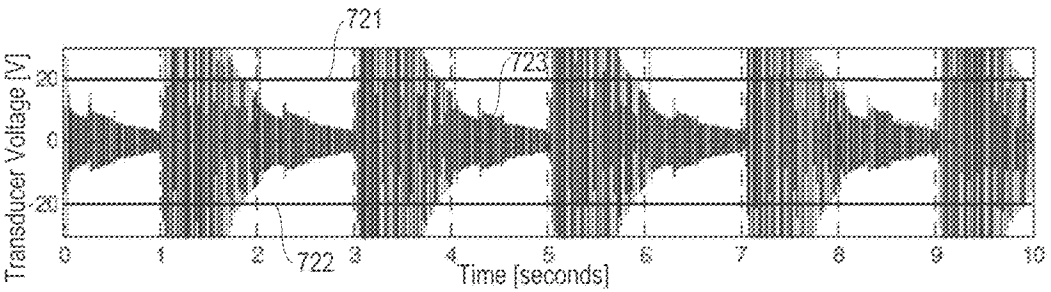
FIG. 9B is an example graph illustrating a transducer voltage response waveform of a conventional loudspeaker with fixed equalization.

FIG. 9B is an example graph 720 illustrating a transducer voltage response waveform of a conventional loudspeaker with fixed equalization. A vertical axis of the graph 720 represents transducer voltage in V. A horizontal axis of the graph 720 represents time in seconds. The graph 720 comprises each of the following: (1) a pair of horizontal lines 721 and 722 representing predetermined voltage limits for an amplifier of the loudspeaker that ensure safe operation of the loudspeaker for mechanical protection (e.g., ensure safe operation based on threshold information relating to the amplifier), and (2) a response waveform 723 representing resulting transducer voltage output by the amplifier during audio reproduction. As shown in FIG. 9B, with fixed equalization, the resulting transducer voltage frequently exceeds the predetermined voltage limits.

Figure 9C:
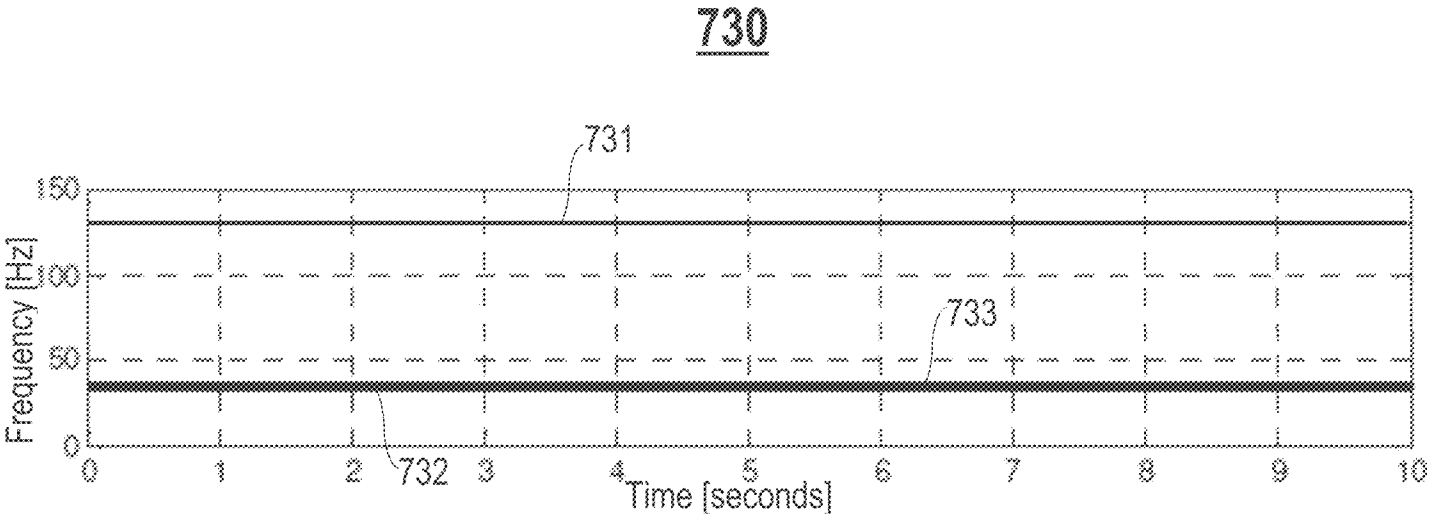
FIG. 9C is an example graph illustrating a cutoff frequency of a high-pass filter (HPF) of a conventional loudspeaker with fixed equalization.

FIG. 9C is an example graph 730 illustrating a cutoff frequency of a HPF of a conventional loudspeaker with fixed equalization. A vertical axis of the graph 730 represents frequency in Hz. A horizontal axis of the graph 730 represents time in seconds. The graph 730 comprises each of the following: (1) a pair of horizontal lines 731 and 732 representing predetermined frequency limits for a HPF of the loudspeaker, wherein the predetermined frequency limits define a frequency range within which the cutoff frequency of the HPF is limited to for reducing excursion, and (2) a response waveform 733 representing resulting cutoff frequency of the HPF during audio reproduction. As shown in FIG. 9C, with fixed equalization, the resulting cutoff frequency is set to one of the predetermined frequency limits (e.g., the lowest predetermined frequency limit).

Figure 10A:
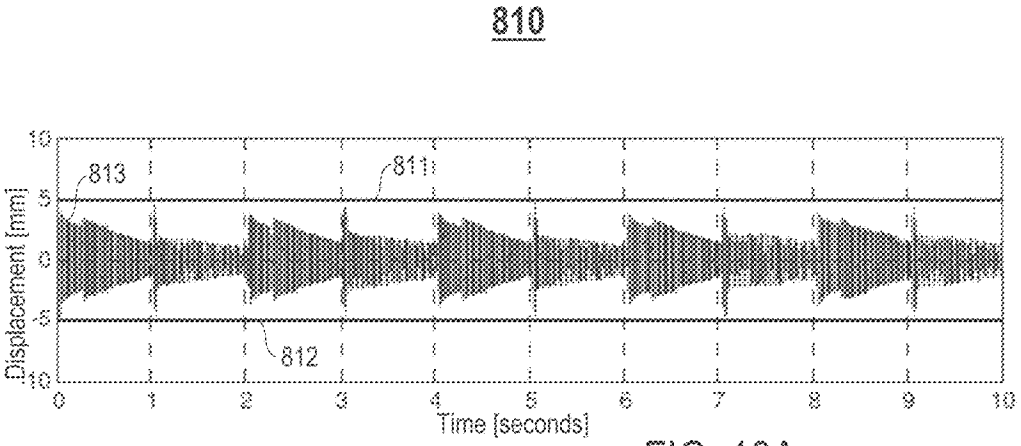
FIG. 10A is an example graph illustrating a displacement response waveform of the loudspeaker device with sliding equalization, in accordance with an embodiment.

FIG. 10A is an example graph 810 illustrating a displacement response waveform of the loudspeaker device 50 with sliding equalization, in accordance with an embodiment. A vertical axis of the graph 810 represents displacement in mm. A horizontal axis of the graph 810 represents time in seconds. The graph 810 comprises each of the following: (1) a pair of horizontal lines 811 and 812 representing predetermined displacement limits for one or more moving components (e.g., diaphragm 56 and/or driver voice coil 57) of the loudspeaker device 50 that ensure safe operation of the loudspeaker device 50 for mechanical protection (e.g., ensure safe operation based on threshold information relating to safe displacement of the one or more moving components, such as predetermined maximum displacement limit $x_{max}$ and predetermined minimum displacement limit $x_{min}$), and (2) a response waveform 813 representing resulting actual displacement of the one or more moving components during audio reproduction (e.g., resulting target displacement x*). As shown in FIG. 10A, with sliding equalization, the resulting actual displacement is limited/restricted within the predetermined displacement limits.

Figure 10B:
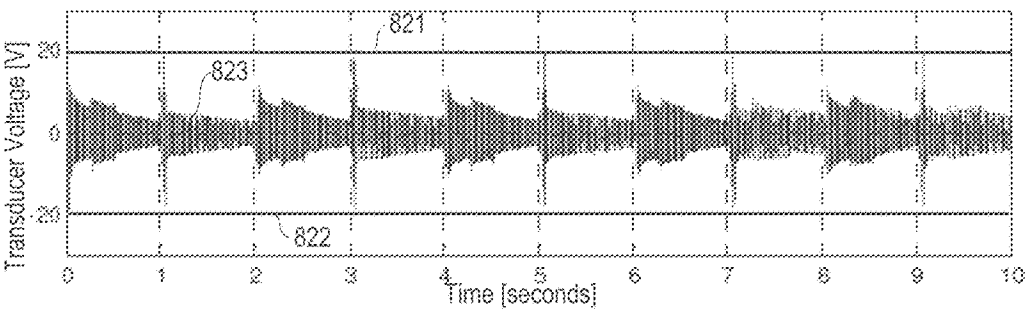
FIG. 10B is an example graph illustrating a transducer voltage response waveform of the loudspeaker device with sliding equalization, in accordance with an embodiment.

FIG. 10B is an example graph 820 illustrating a transducer voltage response waveform of the loudspeaker device 50 with sliding equalization, in accordance with an embodiment. A vertical axis of the graph 820 represents transducer voltage in V. A horizontal axis of the graph 820 represents time in seconds. The graph 820 comprises each of the following: (1) a pair of horizontal lines 821 and 822 representing predetermined voltage limits for the amplifier 130 of the loudspeaker device 50 that ensure safe operation of the loudspeaker device 50 for mechanical protection (e.g., ensure safe operation based on threshold information relating to the amplifier 130, such as predetermined maximum voltage limit $u_{max}$ and predetermined minimum voltage limit $u_{min}$), and (2) a response waveform 823 representing resulting transducer voltage output by the amplifier 130 during audio reproduction (e.g., control voltage u*). As shown in FIG. 10B, with sliding equalization, the resulting transducer voltage is limited/restricted within the predetermined voltage limits.

Figure 10C:
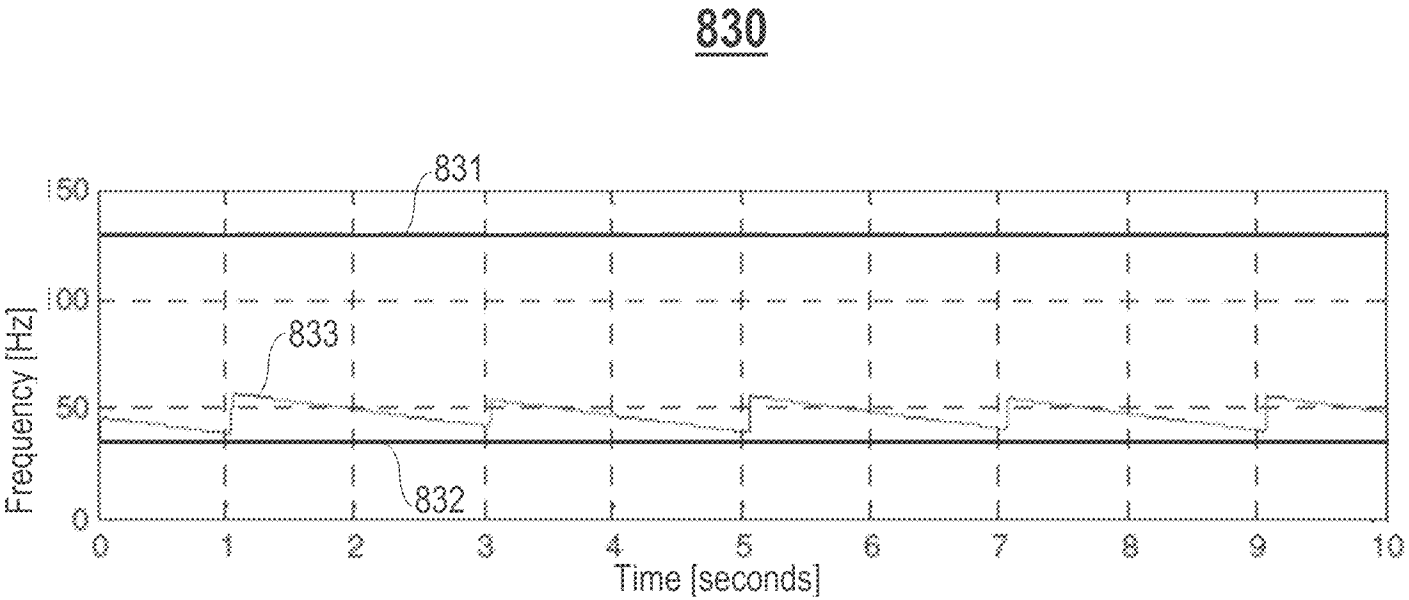
FIG. 10C is an example graph illustrating a cutoff frequency of the HPF of the loudspeaker device with sliding equalization, in accordance with an embodiment.

FIG. 10C is an example graph 830 illustrating a cutoff frequency of the HPF 180 of the loudspeaker device 50 with sliding equalization, in accordance with an embodiment. A vertical axis of the graph 830 represents frequency in Hz. A horizontal axis of the graph 830 represents time in seconds. The graph 830 comprises each of the following: (1) a pair of horizontal lines 831 and 832 representing predetermined frequency limits for the HPF 180 of the loudspeaker device 50, wherein the predetermined frequency limits define a frequency range within which a cutoff frequency of the HPF 180 is limited to for reducing excursion, and (2) a response waveform 833 representing resulting cutoff frequency of the HPF 180 during audio reproduction. As shown in FIG. 10C, with sliding equalization, the resulting cutoff frequency is limited/restricted within the predetermined frequency limits.

Figure 11:
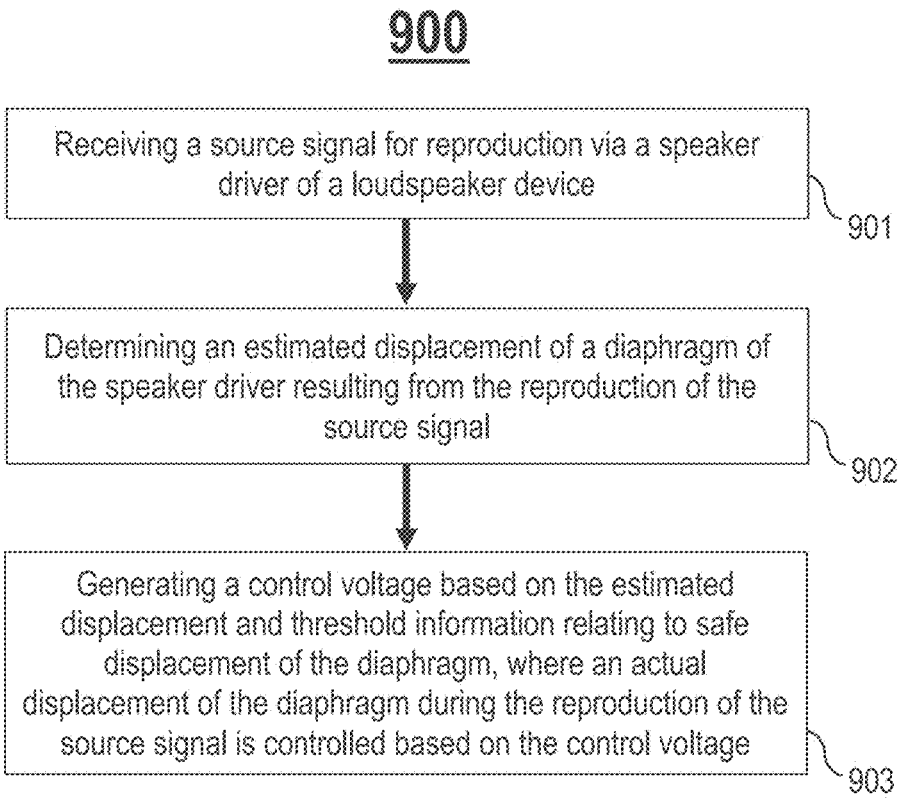
FIG. 11 is an example flowchart of a process for implementing a displacement limiter for loudspeaker mechanical protection, in accordance with an embodiment.

FIG. 11 is an example flowchart of a process 900 for implementing a displacement limiter for loudspeaker mechanical protection, in accordance with an embodiment. Process block 901 includes receiving a source signal for reproduction via a speaker driver (e.g., speaker driver 52) of a loudspeaker device (e.g., loudspeaker device 50). Process block 902 includes determining an estimated displacement of a diaphragm (e.g., diaphragm 56) of the speaker driver resulting from the reproduction of the source signal. Process block 903 includes generating a control voltage based on the estimated displacement and threshold information relating to safe displacement of the diaphragm, where an actual displacement of the diaphragm during the reproduction of the source signal is controlled based on the control voltage.

In one embodiment, one or more components of the displacement limiter system 100, such as the controller 101, is configured to perform process blocks 901-903.

Figure 12:
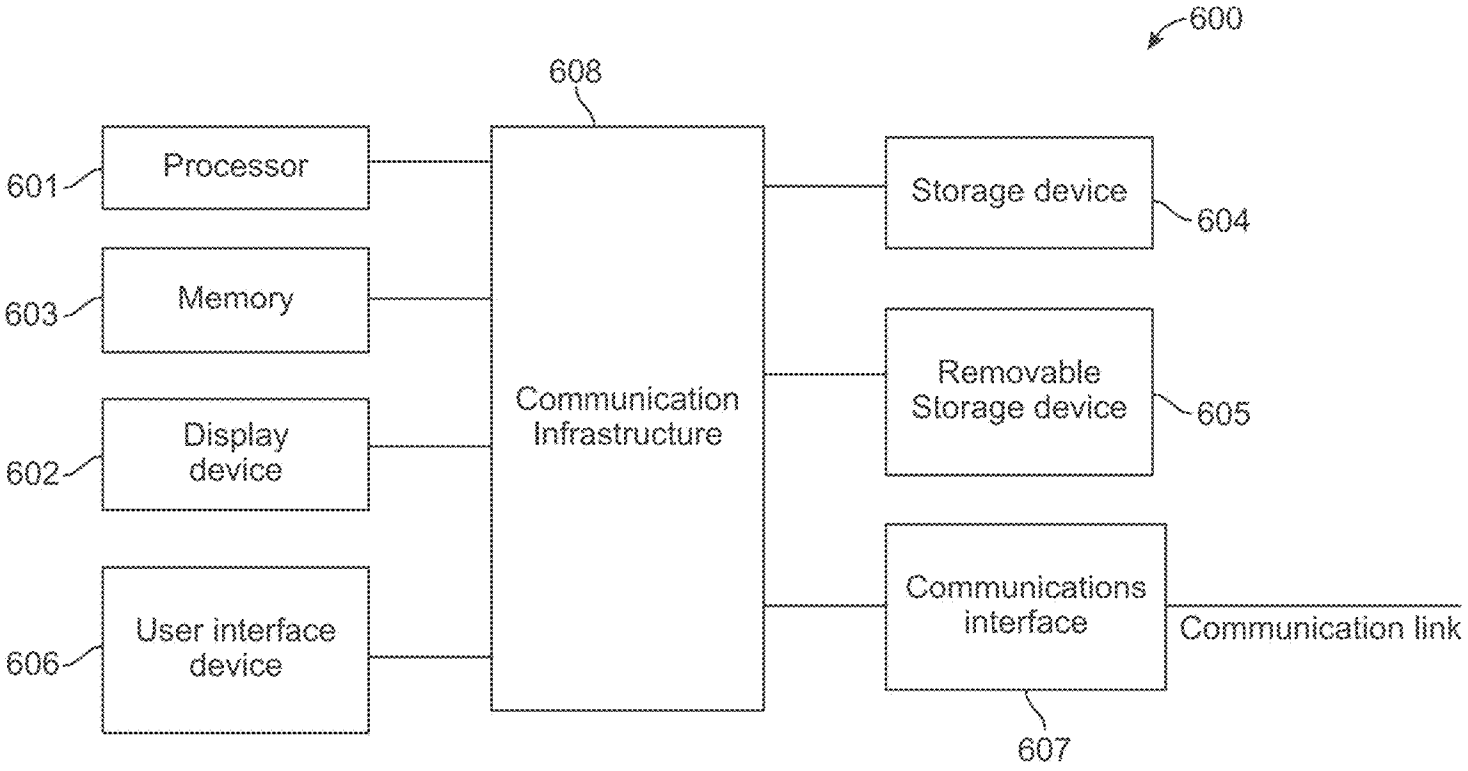
FIG. 12 is a high-level block diagram showing an information processing system comprising a computer system useful for implementing various disclosed embodiments.

FIG. 12 is a high-level block diagram showing an information processing system comprising a computer system 600 that can be useful for implementing various embodiments or aspects of the disclosed technology. The computer system 600 includes one or more processors 601, and can further include an electronic display device 602 (for displaying video, graphics, text, and other data), a main memory 603 (e.g., random access memory (RAM)), storage device 604 (e.g., hard disk drive), removable storage device 605 (e.g., removable storage drive, removable memory module, a magnetic tape drive, optical disk drive, computer readable medium having stored therein computer software and/or data), user interface device 606 (e.g., keyboard, touch screen, keypad, pointing device), and a communication interface 607 (e.g., modem, a network interface (such as an Ethernet card), a communications port, or a PCMCIA slot and card).

The communication interface 607 allows software and data to be transferred between the computer system 600 and external devices. The system 600 further includes a communications infrastructure 608 (e.g., a communications bus, cross-over bar, or network) to which the aforementioned devices/modules 601 through 607 are connected.

Information transferred via the communications interface 607 may be in the form of signals such as electronic, electromagnetic, optical, or other signals capable of being received by communications interface 607, via a communication link that carries signals and may be implemented using wire or cable, fiber optics, a phone line, a cellular phone link, a radio frequency (RF) link, and/or other communication channels. Computer program instructions representing the block diagrams and/or flowcharts herein may be loaded onto a computer, programmable data processing apparatus, or processing devices to cause a series of operations performed thereon to produce a computer implemented process. In one embodiment, processing instructions for process 900 (FIG. 11) may be stored as program instructions on the memory 603, storage device 604, and/or the removable storage device 605 for execution by the processor 601.

Embodiments have been described with reference to flowchart illustrations and/or block diagrams of methods, apparatus (systems), and computer program products. In some cases, each block of such illustrations/diagrams, or combinations thereof, can be implemented by computer program instructions. The computer program instructions when provided to a processor produce a machine, such that the instructions, which executed via the processor create means for implementing the functions/operations specified in the flowchart and/or block diagram. Each block in the flowchart/block diagrams may represent a hardware and/or software module or logic. In alternative implementations, the functions noted in the blocks may occur out of the order noted in the figures, concurrently, etc.

The terms "computer program medium," "computer usable medium," "computer readable medium," and "computer program product," are used to generally refer to media such as main memory, secondary memory, removable storage drive, a hard disk installed in hard disk drive, and signals. These computer program products are means for providing software to the computer system. The computer readable medium allows the computer system to read data, instructions, messages or message packets, and other computer readable information from the computer readable medium. The computer readable medium, for example, may include non-volatile memory, such as a floppy disk, ROM, flash memory, disk drive memory, a CD-ROM, and other permanent storage. It is useful, for example, for transporting information, such as data and computer instructions, between computer systems. Computer program instructions may be stored in a computer readable medium that can direct a computer, other programmable data processing apparatuses, or other devices to function in a particular manner, such that the instructions stored in the computer readable medium produce an article of manufacture including instructions which implement the function/act specified in the flowchart and/or block diagram block(s).

As will be appreciated by one skilled in the art, aspects of the embodiments may be embodied as a system, method or computer program product. Accordingly, aspects of the embodiments may take the form of an entirely hardware embodiment, an entirely software embodiment (including firmware, resident software, micro-code, etc.) or an embodiment combining software and hardware aspects that may all generally be referred to herein as a "circuit," "module," or "system." Furthermore, aspects of the embodiments may take the form of a computer program product embodied in one or more computer readable medium(s) having computer readable program code embodied thereon.

Any combination of one or more computer readable medium(s) may be utilized. The computer readable medium may be a computer readable storage medium (e.g., a non-transitory computer readable storage medium). A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program code for carrying out operations for aspects of one or more embodiments may be written in any combination of one or more programming languages, including an object oriented programming language such as Java, Smalltalk, C++, or the like, and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

In some cases, aspects of one or more embodiments are described above with reference to flowchart illustrations and/or block diagrams of methods, apparatuses (systems), and computer program products. In some instances, it will be understood that each block of the flowchart illustrations and/or block diagrams, and combinations of blocks in the flowchart illustrations and/or block diagrams, can be implemented by computer program instructions. These computer program instructions may be provided to a special purpose computer, or other programmable data processing apparatus to produce a machine, such that the instructions, which execute via the processor of the computer or other programmable data processing apparatus, create means for implementing the functions/acts specified in the flowchart and/or block diagram block(s).

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block(s).

The computer program instructions may also be loaded onto a computer, other programmable data processing apparatuses, or other devices to cause a series of operational steps to be performed on the computer, other programmable apparatuses, or other devices to produce a computer implemented process such that the instructions which execute on the computer or other programmable apparatuses provide processes for implementing the functions/acts specified in the flowchart and/or block diagram block(s).

The flowchart and block diagrams in the Figures illustrate the architecture, functionality, and operation of possible implementations of systems, methods, and computer program products according to various embodiments. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

References in the claims to an element in the singular is not intended to mean "one and only" unless explicitly so stated, but rather "one or more." All structural and functional equivalents to the elements of the above-described exemplary embodiment that are currently known or later come to be known to those of ordinary skill in the art are intended to be encompassed by the present claims. No claim element herein is to be construed under the provisions of pre-AIA 35 U.S.C. section 112, sixth paragraph, unless the element is expressly recited using the phrase "means for" or "step for."

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the embodiments has been presented for purposes of illustration and description, but is not intended to be exhaustive or limited to the embodiments in the form disclosed. Many modifications and variations will be apparent to those of ordinary skill in the art without departing from the scope and spirit of the invention.

Though the embodiments have been described with reference to certain versions thereof; however, other versions are possible. Therefore, the spirit and scope of the appended claims should not be limited to the description of the preferred versions contained herein.

What is claimed is:

1. A device comprising:

a speaker driver including a diaphragm; and a controller configured to:

receive a source signal for reproduction via the speaker driver; and at a time sample of the source signal:

determine an estimated displacement of the diaphragm at the time sample that results from reproduction of the time sample via the speaker driver;

determine a target displacement of the diaphragm based on the estimated displacement and threshold information relating to safe displacement of the diaphragm;

determine a control voltage that produces the target displacement; and instantaneously correct the time sample by modifying a voltage for amplifying the time sample based on the control voltage to limit an actual displacement of the diaphragm at the time sample to the target displacement during the reproduction of the time sample.

2. The device of claim 1, wherein the controller is further configured to:

determine whether the reproduction of the time sample results in a potential excess of displacement of the diaphragm at the time sample based on a comparison of the estimated displacement with a predetermined range of safe displacement included in the threshold information; and in response to determining the reproduction of the time sample results in a potential excess of displacement of the diaphragm at the time sample, determine the target displacement that is within the predetermined range of safe displacement.

3. The device of claim 1, wherein the controller is further configured to determine the control voltage based on the target displacement and a physical model of the speaker driver.

4. The device of claim 3, wherein the physical model is based on at least two or more of: a direct current (DC) resistance of a driver voice coil of the speaker driver, a mechanical mass of the diaphragm including the driver voice coil and air load, a mechanical resistance of total losses of the speaker driver, a force factor of the driver voice coil, an inductance of the driver voice coil, or a stiffness of suspension of the speaker driver.

5. The device of claim 1, wherein the controller is further configured to apply voltage correction by:

at each time sample of the source signal:

determining a corresponding estimated displacement of the diaphragm at the time sample that results from reproduction of the time sample via the speaker driver;

determining whether the reproduction of the time sample results in a potential excess of displacement of the diaphragm at the time sample based on a comparison of the corresponding estimated displacement with a predetermined range of safe displacement included in the threshold information; and instantaneously correcting the time sample by modifying a corresponding voltage for amplifying the time sample in response to determining that the reproduction of the time sample results in a potential excess of displacement of the diaphragm at the time sample.

6. The device of claim 1, wherein the controller comprises an adaptive filter, and the adaptive filter is configured to dynamically attenuate sound reproduced by the speaker driver at one or more predetermined frequency ranges to maintain the actual displacement within a predetermined range of safe displacement included in the threshold information.

7. The device of claim 6, further comprising:

an amplifier;

wherein the controller is further configured to update a cutoff frequency of the adaptive filter based on a comparison of a requested output voltage of the amplifier with an output voltage threshold of the amplifier, and the output voltage threshold is indicative of a maximum output voltage of the amplifier.

8. The device of claim 3, wherein the physical model is a linear model.

9. The device of claim 3, wherein the physical model is a nonlinear model.

10. The device of claim 1, wherein the controller is further configured to determine the target displacement by applying at least one of a time-domain algorithm or a frequency-domain algorithm to the estimated displacement.

11. A method comprising:

receiving a source signal; and at a time sample of the source signal:

determining an estimated displacement of a diaphragm of a speaker driver at the time sample that results from reproduction of the time sample via the speaker driver;

determining a target displacement of the diaphragm based on the estimated displacement and threshold information relating to safe displacement of the diaphragm;

determining a control voltage that produces the target displacement; and instantaneously correct the time sample by modifying a voltage for amplifying the time sample based on the control voltage to limit an actual displacement of the diaphragm at the time sample to the target displacement during the reproduction of the time sample.

12. The method of claim 11, further comprising:

determining whether the reproduction of the time sample results in a potential excess of displacement of the diaphragm at the time sample based on a comparison of the estimated displacement with a predetermined range of safe displacement included in the threshold information; and in response to determining the reproduction of the time sample results in a potential excess of displacement of the diaphragm at the time sample, determining the target displacement that is within the predetermined range of safe displacement.

13. The method of claim 11, further comprising:

determining the control voltage based on the target displacement and a physical model of the speaker driver.

14. The method of claim 11, further comprising:

applying voltage correction by:

at each time sample of the source signal:

determining a corresponding estimated displacement of the diaphragm at the time sample that results from reproduction of the time sample via the speaker driver;

determining whether the reproduction of the time sample results in a potential excess of displacement of the diaphragm at the time sample based on a comparison of the corresponding estimated displacement with a predetermined range of safe displacement included in the threshold information; and instantaneously correcting the time sample by modifying a corresponding voltage for amplifying the time sample in response to determining that the reproduction of the time sample results in a potential excess of displacement of the diaphragm at the time sample.

15. The method of claim 14, further comprising:

dynamically attenuating sound reproduced by the speaker driver at one or more predetermined frequency ranges to maintain the actual displacement within a predetermined range of safe displacement included in the threshold information.

16. A system comprising:

a controller configured to:

receive a source signal; and at a time sample of the source signal:

determine an estimated displacement of a diaphragm of a speaker driver at the time sample that results from reproduction of the time sample via the speaker driver;

determine a target displacement of the diaphragm based on the estimated displacement and threshold information relating to safe displacement of the diaphragm;

determine a control voltage that produces the target displacement; and instantaneously correct the time sample by modifying a voltage for amplifying the time sample based on the control voltage to limit an actual displacement of the diaphragm at the time sample to the target displacement during the reproduction of the time sample.

17. The system of claim 16, wherein the controller is further configured to:

determine whether the reproduction of the time sample results in a potential excess of displacement of the diaphragm at the time sample based on a comparison of the estimated displacement with a predetermined range of safe displacement included in the threshold information; and in response to determining the reproduction of the time sample results in a potential excess of displacement of the diaphragm at the time sample, determine the target displacement that is within the predetermined range of safe displacement.

18. The system of claim 16, wherein the controller is further configured to:

determine the control voltage based on the target displacement and a physical model of the speaker driver.

19. The system of claim 16, wherein the controller is further configured to apply voltage correction by:

at each time sample of the source signal:

determining a corresponding estimated displacement of the diaphragm at the time sample that results from reproduction of the time sample via the speaker driver;

determining whether the reproduction of the time sample results in a potential excess of displacement of the diaphragm at the time sample based on a comparison of the corresponding estimated displacement with a predetermined range of safe displacement included in the threshold information; and instantaneously correcting the time sample by modifying a corresponding voltage for amplifying the time sample in response to determining that the reproduction of the time sample results in a potential excess of displacement of the diaphragm at the time sample.

20. The system of claim 16, wherein the controller is further configured to:

dynamically attenuate sound reproduced by the speaker driver at one or more predetermined frequency ranges to maintain the actual displacement within a predetermined range of safe displacement included in the threshold information.

* * * * *